US007475732B2

(12) United States Patent
Hosie et al.

(10) Patent No.: US 7,475,732 B2
(45) **Date of Patent: *Jan. 13, 2009**

(54) INSTRUMENTATION FOR A DOWNHOLE DEPLOYMENT VALVE

(75) Inventors: David G. Hosie, Sugar Land, TX (US); Michael Brian Grayson, Sugar Land, TX (US); Ramkumar K. Bansal, Houston, TX (US); Francis X. Bostick, III, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/743,808

(22) Filed: May 3, 2007

(65) Prior Publication Data

US 2007/0205000 A1 Sep. 6, 2007

Related U.S. Application Data

(63) Continuation of application No. 10/677,135, filed on Oct. 1, 2003, now Pat. No. 7,255,173, which is a continuation-in-part of application No. 10/288,229, filed on Nov. 5, 2002.

(51) Int. Cl.
*E21B 34/06* (2006.01)

(52) U.S. Cl. ..... 166/373; 166/66; 175/40

(58) Field of Classification Search ..... 166/374, 166/373, 358, 367, 250.01, 66; 175/57, 40
See application file for complete search history.

(56) References Cited

U.S. PATENT DOCUMENTS 2,290,406 A 7/1942 Chambers
3,362,487 A 1/1968 Lindsey
3,517,553 A 6/1970 Williams et al.
3,552,502 A 1/1971 Wilson, Sr.

(Continued)

FOREIGN PATENT DOCUMENTS

EP 945 590 9/1999

(Continued)

OTHER PUBLICATIONS

Canadian Examination Report, Application No. 2,483,527, dated Aug. 17, 2007.

(Continued)

*Primary Examiner*—Kenneth Thompson
(74) *Attorney, Agent, or Firm*—Patterson & Sheridan, L.L.P.

(57) ABSTRACT

The present generally relates to apparatus and methods for instrumentation associated with a downhole deployment valve or a separate instrumentation sub. In one aspect, a DDV in a casing string is closed in order to isolate an upper section of a wellbore from a lower section. Thereafter, a pressure differential above and below the closed valve is measured by downhole instrumentation to facilitate the opening of the valve. In another aspect, the instrumentation in the DDV includes sensors placed above and below a flapper portion of the valve. The pressure differential is communicated to the surface of the well for use in determining what amount of pressurization is needed in the upper portion to safely and effectively open the valve. Additionally, instrumentation associated with the DDV can include pressure, temperature, seismic, acoustic, and proximity sensors to facilitate the use of not only the DDV but also telemetry tools.

26 Claims, 11 Drawing Sheets

U.S. PATENT DOCUMENTS

| | | | |
|---|---|---|---|
| 3,831,138 | A | 8/1974 | Rammner |
| 3,986,350 | A | 10/1976 | Schmidt |
| 4,015,234 | A | 3/1977 | Krebs |
| 4,160,970 | A | 7/1979 | Nicolson |
| 4,247,312 | A | 1/1981 | Thakur et al. |
| 4,297,880 | A | 11/1981 | Berger |
| 4,367,794 | A | 1/1983 | Bednar et al. |
| 4,440,239 | A | 4/1984 | Evans |
| 4,553,428 | A | 11/1985 | Upchurch |
| 4,630,675 | A | 12/1986 | Neipling et al. |
| 4,691,203 | A | 9/1987 | Rubin et al. |
| 4,739,325 | A | 4/1988 | MacLeod |
| 4,775,009 | A | 10/1988 | Wittrisch et al. |
| 5,010,966 | A | 4/1991 | Stokley et al. |
| 5,014,781 | A | 5/1991 | Smith |
| 5,172,717 | A | 12/1992 | Boyle et al. |
| 5,235,285 | A | 8/1993 | Clark et al. |
| 5,293,551 | A | 3/1994 | Perkins et al. |
| 5,303,773 | A | 4/1994 | Czernichow et al. |
| 5,355,952 | A | 10/1994 | Meynier |
| 5,358,035 | A | 10/1994 | Grudzinski |
| 5,512,889 | A | 4/1996 | Fletcher |
| 5,661,402 | A | 8/1997 | Chesnutt et al. |
| 5,730,219 | A | 3/1998 | Tubel et al. |
| 5,857,522 | A | 1/1999 | Bradfield et al. |
| 5,892,860 | A | 4/1999 | Maron et al. |
| 5,900,137 | A | 5/1999 | Homan |
| 5,971,072 | A | 10/1999 | Huber et al. |
| 5,992,519 | A | 11/1999 | Ramakrishnan et al. |
| 5,996,687 | A | 12/1999 | Pringle et al. |
| 6,006,828 | A | 12/1999 | Kluth et al. |
| 6,006,832 | A | 12/1999 | Tubel et al. |
| 6,018,501 | A | 1/2000 | Smith et al. |
| 6,035,952 | A | 3/2000 | Bradfield et al. |
| 6,041,864 | A | 3/2000 | Patel et al. |
| 6,072,567 | A | 6/2000 | Sapack |
| 6,075,462 | A | 6/2000 | Smith |
| 6,095,250 | A | 8/2000 | Day et al. |
| 6,138,774 | A | 10/2000 | Bourgoyne, Jr. et al. |
| 6,173,772 | B1 | 1/2001 | Vaynshteyn |
| 6,176,312 | B1 | 1/2001 | Tubel et al. |
| 6,179,052 | B1 | 1/2001 | Purkis et al. |
| 6,191,586 | B1 | 2/2001 | Bittar |
| 6,199,629 | B1 | 3/2001 | Shirk et al. |
| 6,209,663 | B1 | 4/2001 | Hosie |
| 6,234,258 | B1 | 5/2001 | Karigan |
| 6,247,536 | B1 | 6/2001 | Leismer et al. |
| 6,269,874 | B1 | 8/2001 | Rawson et al. |
| 6,279,660 | B1 | 8/2001 | Hay |
| 6,283,207 | B1 | 9/2001 | Lemetayer |
| 6,308,137 | B1 | 10/2001 | Underhill et al. |
| 6,325,146 | B1 | 12/2001 | Ringgenberg et al. |
| 6,328,118 | B1 | 12/2001 | Karigan et al. |
| 6,343,649 | B1 | 2/2002 | Beck et al. |
| 6,352,129 | B1 | 3/2002 | Best |
| 6,354,147 | B1 | 3/2002 | Gysling et al. |
| 6,374,925 | B1 | 4/2002 | Elkins et al. |
| 6,386,288 | B1 | 5/2002 | Snider et al. |
| 6,422,084 | B1 | 7/2002 | Fernald et al. |
| 6,425,444 | B1 | 7/2002 | Metcalfe et al. |
| 6,427,776 | B1 | 8/2002 | Hoffman et al. |
| 6,429,784 | B1 | 8/2002 | Beique et al. |
| 6,457,540 | B2 | 10/2002 | Gardes et al. |
| 6,478,091 | B1 | 11/2002 | Gano |
| 6,484,816 | B1 | 11/2002 | Koederitz |
| 6,508,309 | B1 * | 1/2003 | French ..... 166/323 |
| 6,531,694 | B2 | 3/2003 | Tubel et al. |
| 6,575,244 | B2 | 6/2003 | Chang et al. |
| 6,585,041 | B2 | 7/2003 | Crossley |
| 6,598,675 | B2 | 7/2003 | Bussear et al. |
| 6,607,042 | B2 | 8/2003 | Hoyer et al. |
| 6,644,110 | B1 | 11/2003 | Curtis et al. |
| 6,668,943 | B1 | 12/2003 | Maus et al. |
| 6,684,950 | B2 | 2/2004 | Patel |
| 6,755,261 | B2 | 6/2004 | Koederitz |
| 6,814,142 | B2 | 11/2004 | Paulk et al. |
| 6,851,481 | B2 | 2/2005 | Vinegar et al. |
| 6,904,981 | B2 | 6/2005 | Van Riet |
| 6,912,177 | B2 | 6/2005 | Smith |
| 6,920,942 | B2 | 7/2005 | Koederitz |
| 6,951,252 | B2 | 10/2005 | Restarick et al. |
| 6,966,373 | B2 | 11/2005 | Von Gynz-Rekowski |
| 7,004,448 | B2 | 2/2006 | Suter et al. |
| 7,044,237 | B2 | 5/2006 | Leuchtenberg |
| 7,044,239 | B2 | 5/2006 | Pinckard et al. |
| 2001/0048089 | A1 | 12/2001 | Clark et al. |
| 2003/0150621 | A1 | 8/2003 | Pia |
| 2003/0155131 | A1 | 8/2003 | Vick, Jr. |
| 2003/0192695 | A1 * | 10/2003 | Dillenbeck et al. ..... 166/285 |
| 2004/0065446 | A1 | 4/2004 | Tran et al. |
| 2004/0139791 | A1 | 7/2004 | Johansen |
| 2004/0178003 | A1 | 9/2004 | Riet |
| 2004/0231889 | A1 | 11/2004 | Van Riet |
| 2004/0251032 | A1 | 12/2004 | Luke et al. |
| 2005/0092523 | A1 | 5/2005 | McCaskill et al. |
| 2005/0115708 | A1 | 6/2005 | Jabusch |
| 2006/0011236 | A1 | 1/2006 | Suter et al. |
| 2006/0065402 | A9 * | 3/2006 | Fontana et al. ..... 166/358 |
| 2006/0086538 | A1 | 4/2006 | Van Riet |
| 2006/0124300 | A1 | 6/2006 | Steiner et al. |
| 2006/0207795 | A1 | 9/2006 | Kinder et al. |

FOREIGN PATENT DOCUMENTS

| | | |
|---|---|---|
| GB | 2154632 | 9/1985 |
| GB | 2299915 | 10/1996 |
| GB | 2330598 | 4/1999 |
| GB | 2 335453 | 9/1999 |
| GB | 2360532 | 9/2001 |
| GB | 2381282 | 4/2003 |
| GB | 2394242 | 4/2004 |
| GB | 2394974 | 5/2004 |
| GB | 2400125 | 10/2004 |
| GB | 2403250 | 12/2004 |
| WO | WO 98/50681 | 11/1998 |
| WO | WO2004020774 | 3/2004 |

OTHER PUBLICATIONS

Downhole Deployment Valve Bulletin, Weatherford International Ltd., (online) Jan. 2003. Available from http://www.weatherford.com/weatherford/groups/public/documents/general/wft004406.pdf.

Nimir Field In Oman Proves The Downhole Deployment Valve A Vital Technological Key To Success, Weatherford International Ltd., (online) 2003. Available at http://www.weatherford.com/weatherford/groups/public/documents/general/wft004337.pdf.

* cited by examiner

INSTRUMENTATION FOR A DOWNHOLE DEPLOYMENT VALVE

CROSS-REFERENCE TO RELATED APPLICATIONS

This application is a continuation of U.S. patent application Ser. No. 10/677,135, filed Oct. 1, 2003, now U.S. Pat. No. 7,255,173 which is a continuation-in-part of co-pending U.S. patent application Ser. No. 10/288,229, filed Nov. 5, 2002, which are hereby incorporated by reference in their entireties.

U.S. patent application Ser. No. 10/676,376, filed on Oct. 1, 2003, entitled "Permanent Downhole Deployment of Optical Sensors", is herein incorporated by reference in its entirety.

BACKGROUND OF THE INVENTION

1. Field of the Invention

The present invention generally relates to methods and apparatus for use in oil and gas wellbores. More particularly, the invention relates to using instrumentation to monitor downhole conditions within wellbores. More particularly, the invention relates to methods and apparatus for controlling the use of valves and other automated downhole tools through the use of instrumentation that can additionally be used as a relay to the surface. More particularly still, the invention relates to the use of deployment valves in wellbores in order to temporarily isolate an upper portion of the wellbore from a lower portion thereof.

2. Description of the Related Art

Oil and gas wells typically begin by drilling a borehole in the earth to some predetermined depth adjacent a hydrocarbon-bearing formation. After the borehole is drilled to a certain depth, steel tubing or casing is typically inserted in the borehole to form a wellbore and an annular area between the tubing and the earth is filled with cement. The tubing strengthens the borehole and the cement helps to isolate areas of the wellbore during hydrocarbon production.

Historically, wells are drilled in an "overbalanced" condition wherein the wellbore is filled with fluid or mud in order to prevent the inflow of hydrocarbons until the well is completed. The overbalanced condition prevents blow outs and keeps the well controlled. While drilling with weighted fluid provides a safe way to operate, there are disadvantages, like the expense of the mud and the damage to formations if the column of mud becomes so heavy that the mud enters the formations adjacent the wellbore. In order to avoid these problems and to encourage the inflow of hydrocarbons into the wellbore, underbalanced or near underbalanced drilling has become popular in certain instances. Underbalanced drilling involves the formation of a wellbore in a state wherein any wellbore fluid provides a pressure lower than the natural pressure of formation fluids. In these instances, the fluid is typically a gas, like nitrogen and its purpose is limited to carrying out drilling chips produced by a rotating drill bit. Since underbalanced well conditions can cause a blow out, they must be drilled through some type of pressure device like a rotating drilling head at the surface of the well to permit a tubular drill string to be rotated and lowered therethrough while retaining a pressure seal around the drill string. Even in overbalanced wells there is a need to prevent blow outs. In most every instance, wells are drilled through blow out preventers in case of a pressure surge.

As the formation and completion of an underbalanced or near underbalanced well continues, it is often necessary to insert a string of tools into the wellbore that cannot be inserted through a rotating drilling head or blow out preventer due to their shape and relatively large outer diameter. In these instances, a lubricator that consists of a tubular housing tall enough to hold the string of tools is installed in a vertical orientation at the top of a wellhead to provide a pressurizable temporary housing that avoids downhole pressures. By manipulating valves at the upper and lower end of the lubricator, the string of tools can be lowered into a live well while keeping the pressure within the well localized. Even a well in an overbalanced condition can benefit from the use of a lubricator when the string of tools will not fit though a blow out preventer. The use of lubricators is well known in the art and the forgoing method is more fully explained in U.S. patent application Ser. No. 09/536,937, filed 27 Mar. 2000, and that published application is incorporated by reference herein in its entirety.

While lubricators are effective in controlling pressure, some strings of tools are too long for use with a lubricator. For example, the vertical distance from a rig floor to the rig draw works is typically about ninety feet or is limited to that length of tubular string that is typically inserted into the well. If a string of tools is longer than ninety feet, there is not room between the rig floor and the draw works to accommodate a lubricator. In these instances, a down hole deployment valve or DDV can be used to create a pressurized housing for the string of tools. Downhole deployment valves are well known in the art and one such valve is described in U.S. Pat. No. 6,209,663, which is incorporated by reference herein in its entirety. Basically, a DDV is run into a well as part of a string of casing. The valve is initially in an open position with a flapper member in a position whereby the full bore of the casing is open to the flow of fluid and the passage of tubular strings and tools into and out of the wellbore. In the valve taught in the '663 patent, the valve includes an axially moveable sleeve that interferes with and retains the flapper in the open position. Additionally, a series of slots and pins permits the valve to be openable or closable with pressure but to then remain in that position without pressure continuously applied thereto. A control line runs from the DDV to the surface of the well and is typically hydraulically controlled. With the application of fluid pressure through the control line, the DDV can be made to close so that its flapper seats in a circular seat formed in the bore of the casing and blocks the flow of fluid through the casing. In this manner, a portion of the casing above the DDV is isolated from a lower portion of the casing below the DDV.

The DDV is used to install a string of tools in a wellbore as follows: When an operator wants to install the tool string, the DDV is closed via the control line by using hydraulic pressure to close the mechanical valve. Thereafter, with an upper portion of the wellbore isolated, a pressure in the upper portion is bled off to bring the pressure in the upper portion to a level approximately equal to one atmosphere. With the upper portion depressurized, the wellhead can be opened and the string of tools run into the upper portion from a surface of the well, typically on a string of tubulars. A rotating drilling head or other stripper like device is then sealed around the tubular string or movement through a blowout preventer can be re-established. In order to reopen the DDV, the upper portion of the wellbore must be repressurized in order to permit the downwardly opening flapper member to operate against the pressure therebelow. After the upper portion is pressurized to a predetermined level, the flapper can be opened and locked in place. Now the tool string is located in the pressurized wellbore.

Presently there is no instrumentation to know a pressure differential across the flapper when it is in the closed position.

This information is vital for opening the flapper without applying excessive force. A rough estimate of pressure differential is obtained by calculating fluid pressure below the flapper from wellhead pressure and hydrostatic head of fluid above the flapper. Similarly when the hydraulic pressure is applied to the mandrel to move it one way or the other, there is no way to know the position of the mandrel at any time during that operation. Only when the mandrel reaches dead stop, its position is determined by rough measurement of the fluid emanating from the return line. This also indicates that the flapper is either fully opened or fully closed. The invention described here is intended to take out the uncertainty associated with the above measurements.

In addition to monitoring the pressure differential across the flapper and the position of the flapper in a DDV, it is sometimes desirable to monitor well conditions in situ. Recently, technology has enabled well operators to monitor conditions within a wellbore by installing monitoring systems downhole. The monitoring systems permit the operator to monitor multiphase fluid flow, as well as pressure, seismic conditions, vibration of downhole components, and temperature during production of hydrocarbon fluids. Downhole measurements of pressure, temperature, seismic conditions, vibration of downhole components, and fluid flow play an important role in managing oil and gas or other sub-surface reservoirs.

Historically, monitoring systems have used electronic components to provide pressure, temperature, flow rate, water fraction, and other formation and wellbore parameters on a real-time basis during production operations. These monitoring systems employ temperature gauges, pressure gauges, acoustic sensors, seismic sensors, electromagnetic sensors, and other instruments or "sondes", including those which provide nuclear measurements, disposed within the wellbore. Such instruments are either battery operated, or are powered by electrical cables deployed from the surface. The monitoring systems have historically been configured to provide an electrical line that allows the measuring instruments, or sensors, to send measurements to the surface.

Recently, optical sensors have been developed which communicate readings from the wellbore to optical signal processing equipment located at the surface. Optical sensors have been suggested for use to detect seismic information in real time below the surface after the well has been drilled for processing into usable information. Optical sensors may be disposed along tubing strings such as production tubing inserted into an inner diameter of a casing string within a drilled-out wellbore by use of inserting production tubing with optical sensors located thereon. The production tubing is inserted through the inner diameter of the casing strings already disposed within the wellbore after the drilling operation. In either instance, an optical line or cable is run from the surface to the optical sensor downhole. The optical sensor may be a pressure gauge, temperature gauge, acoustic sensor, seismic sensor, or other sonde. The optical line transmits optical signals to the optical signal processor at the surface.

The optical signal processing equipment includes an excitation light source. Excitation light may be provided by a broadband light source, such as a light emitting diode (LED) located within the optical signal processing equipment. The optical signal processing equipment also includes appropriate equipment for delivery of signal light to the sensor(s), e.g., Bragg gratings or lasers and couplers which split the signal light into more than one leg to deliver to more than one sensor. Additionally, the optical signal processing equipment includes appropriate optical signal analysis equipment for analyzing the return signals from the Bragg gratings.

The optical line is typically designed so as to deliver pulses or continuous signals of optic energy from the light source to the optical sensor(s). The optical cable is also often designed to withstand the high temperatures and pressures prevailing within a hydrocarbon wellbore. Preferably, the optical cable includes an internal optical fiber which is protected from mechanical and environmental damage by a surrounding capillary tube. The capillary tube is made of a high strength, rigid-walled, corrosion-resistant material, such as stainless steel. The tube is attached to the sensor by appropriate means, such as threads, a weld, or other suitable method. The optical fiber contains a light guiding core which guides light along the fiber. The core preferably employs one or more Bragg gratings to act as a resonant cavity and to also interact with the sonde.

Optical sensors, in addition to monitoring conditions within a drilled-out well or a portion of a well during production operations, may also be used to acquire seismic information from within a formation prior to drilling a well. Initial seismic data is generally acquired by performing a seismic survey. A seismic survey maps the earth formation in the subsurface of the earth by sending sound energy or acoustic waves down into the formation from a seismic source and recording the "echoes" that return from the rock layers below. The source of the down-going sound energy might come from explosions, seismic vibrators on land, or air guns in marine environments. During a seismic survey, the energy source is moved to multiple preplanned locations on the surface of the earth above the geologic structure of interest. Each time the source is activated, it generates a seismic signal that travels downward through the earth, is reflected, and, upon its return, is recorded at a great many locations on the surface. Multiple energy activation/recording combinations are then combined to create a near continuous profile of the subsurface that can extend for many miles. In a two-dimensional (2-D) seismic survey, the recording locations are generally laid out along a single straight line, whereas in a three-dimensional (3-D) survey the recording locations are distributed across the surface in a grid pattern. In simplest terms, a 2-D seismic line can be thought of as giving a cross sectional picture (vertical slice) of the earth layers as they exist directly beneath the recording locations. A 3-D survey produces a data "cube" or volume that is, at least conceptually, a 3-D picture of the subsurface that lies beneath the survey area. A 4-D survey produces a 3-D picture of the subsurface with respect to time, where time is the fourth dimension.

After the survey is acquired, the data from the survey is processed to remove noise or other undesired information. During the computer processing of seismic data, estimates of subsurface velocity are routinely generated and near surface inhomogeneities are detected and displayed. In some cases, seismic data can be used to directly estimate rock properties (including permeability and elastic parameters), water saturation, and hydrocarbon content. Less obviously, seismic waveform attributes such as phase, peak amplitude, peak-to-trough ratio, and a host of others, can often be empirically correlated with known hydrocarbon occurrences and that correlation applied to seismic data collected over new exploration targets.

The procedure for seismic monitoring with optical sensors after the well has been drilled is the same as above-described in relation to obtaining the initial seismic survey, except that more locations are available for locating the seismic source and seismic sensor, and the optical information must be transmitted to the surface for processing. To monitor seismic conditions within the formation, a seismic source transmits a signal into the formation, then the signal reflects from the formation to the seismic sensor. The seismic source may be located at the surface of the wellbore, in an adjacent wellbore, or within the well. The seismic sensor then transmits the optical information regarding seismic conditions through an optical cable to the surface for processing by a central processing unit or some other signal processing device. The processing occurs as described above in relation to the initial seismic survey. In addition to the seismic source reflecting from the formation to the seismic sensor, a signal may be transmitted directly from the seismic source to the seismic sensor.

Seismic sensors must detect seismic conditions within the formation to some level of accuracy to maintain usefulness; therefore, seismic sensors located on production tubing have ordinarily been placed in firm contact with the inside of casing strings to couple the seismic sensor to the formation, thereby reducing fluid attenuation or distortion of the signal and increasing accuracy of the readings. Coupling the seismic sensor to the formation from production tubing includes distance and therefore requires complicated maneuvers and equipment to accomplish the task.

Although placing the seismic sensor in direct contact with the inside of the casing string allows more accurate readings than current alternatives because of its coupling to the formation, it is desirable to even further increase the accuracy of the seismic readings by placing the seismic sensor closer to the formation from which it is obtaining measurement. The closer the seismic sensor is to the formation, the more accurate the signal obtained. A vibration sensor for example, such as an accelerometer or geophone, must be placed in direct contact with the formation to obtain accurate readings. It is further desirable to decrease the complication of the maneuvers and equipment required to couple the seismic sensor to the formation. Therefore, it is desirable to place the seismic sensor as close to the formation as possible.

While current methods of measuring wellbore and formation parameters using optical sensors allow for temporary measurement of the parameters before the drilling and completion operations of the wellbore at the surface and during production operations on production tubing or other production equipment, there is a need to permanently monitor wellbore and formation conditions and parameters during all wellbore operations, including during the drilling and completion operations of the wellbore. It is thus desirable to obtain accurate real time readings of seismic conditions while drilling into the formation. It is further desirable to permanently monitor downhole conditions before and after production tubing is inserted into the wellbore.

In addition to problems associated with the operation of DDVs, many prior art downhole measurement systems lack reliable data communication to and from control units located on the surface. For example, conventional measurement while drilling (MWD) tools utilize mud pulse, which works fine with incompressible drilling fluids such as a water-based or an oil-based mud, but they do not work when gasified fluids or gases are used in underbalanced drilling. An alternative to this is electromagnetic (EM) telemetry where communication between the MWD tool and the surface monitoring device is established via electromagnetic waves traveling through the formations surrounding the well. However, EM telemetry suffers from signal attenuation as it travels through layers of different types of formations. Any formation that produces more than minimal loss serves as an EM barrier. In particular salt domes tend to completely attenuate or moderate the signal. Some of the techniques employed to alleviate this problem include running an electric wire inside the drill string from the EM tool up to a predetermined depth from where the signal can come to the surface via EM waves and placing multiple receivers and transmitters in the drill string to provide boost to the signal at frequent intervals. However, both of these techniques have their own problems and complexities. Currently, there is no available means to cost efficiently relay signals from a point within the well to the surface through a traditional control line.

Expandable Sand Screens (ESS) consist of a slotted steel tube, around which overlapping layers of filter membrane are attached. The membranes are protected with a pre-slotted steel shroud forming the outer wall. When deployed in the well, ESS looks like a three-layered pipe. Once it is situated in the well, it is expanded with a special tool to come in contact with the wellbore wall. The expander tool includes a body having at least two radially extending members, each of which has a roller that when coming into contact with an inner wall of the ESS, can expand the wall past its elastic limit. The expander tool operates with pressurized fluid delivered in a string of tubulars and is more completely disclosed in U.S. Pat. No. 6,425,444 and that patent is incorporated in its entirety herein by reference. In this manner ESS supports the wall against collapsing into the well, provides a large wellbore size for greater productivity, and allows free flow of hydrocarbons into the well while filtering out sand. The expansion tool contains rollers supported on pressure-actuated pistons. Fluid pressure in the tool determines how far the ESS is expanded. While too much expansion is bad for both the ESS and the well, too little expansion does not provide support to the wellbore wall. Therefore, monitoring and controlling fluid pressure in the expansion tool is very important. Presently fluid pressure is measured with a memory gage, which of course provides information after the job has been completed. A real time measurement is desirable so that fluid pressure can be adjusted during the operation of the tool if necessary.

There is a need therefore, for a downhole system of instrumentation and monitoring that can facilitate the operation of downhole tools. There is a further need for a system of instrumentation that can facilitate the operation of downhole deployment valves. There is yet a further need for downhole instrumentation apparatus and methods that include sensors to measure downhole conditions like pressure, temperature, seismic conditions, flow rate, differential pressure, distributed temperature, and proximity in order to facilitate the efficient operation of the downhole tools. There exists a further need for downhole instrumentation and circuitry to improve communication with existing expansion tools used with expandable sand screens and downhole measurement devices such as MWD and pressure while drilling (PWD) tools. There is a need for downhole instrumentation which requires less equipment to couple to the formation to obtain accurate readings of wellbore and formation parameters. Finally, there exists a need for the ability to measure with substantial accuracy downhole wellbore and formation conditions during drilling into the formation, as well as a need for the ability to subsequently measure downhole conditions after the wellbore is drilled by permanent monitoring.

SUMMARY OF THE INVENTION

The present invention generally relates to methods and apparatus for instrumentation associated with a downhole deployment valve (DDV). In one aspect, a DDV in a casing string is closed in order to isolate an upper section of a wellbore from a lower section. Thereafter, a pressure differential above and below the closed valve is measured by downhole instrumentation to facilitate the opening of the valve. In another aspect, the instrumentation in the DDV includes different kinds of sensors placed in the DDV housing for measuring all important parameters for safe operation of the DDV, a circuitry for local processing of signal received from the sensors, and a transmitter for transmitting the data to a surface control unit.

In another aspect, the instrumentation associated with the DDV includes an optical sensor placed in the DDV housing on the casing string for measuring wellbore conditions prior to, during, and after drilling into the formation. In one aspect, the present invention includes a method for measuring wellbore or formation parameters, comprising placing a downhole tool within a wellbore, the downhole tool comprising a casing string, at least a portion of the casing string comprising a downhole deployment valve, and an optical sensor disposed on the casing string, and lowering a drill string into the wellbore while sensing wellbore or formation parameters with the optical sensor. Another aspect of the present invention provides an apparatus for monitoring conditions within a wellbore or a formation, comprising a casing string, at least a portion of the casing string comprising a downhole deployment valve for selectively obstructing a fluid path through the casing string, and at least one optical sensor disposed on the casing string for sensing one or more parameters within the wellbore or formation. Yet another aspect of the present invention provides a method for permanently monitoring at least one wellbore or formation parameter, comprising placing a casing string within a wellbore, at least a portion of the casing string comprising a downhole deployment valve with at least one optical sensor disposed therein, and sensing at least one wellbore or formation parameter with the optical sensor.

The present invention further includes in another aspect a method for determining flow characteristics of a fluid flowing through a casing string, comprising providing a casing string within a wellbore comprising a downhole deployment valve and at least one optical sensor coupled thereto, measuring characteristics of fluid flowing through the casing string using the at least one optical sensor, and determining at least one of a volumetric phase fraction for the fluid or flow rate for the fluid based on the measured fluid characteristics. Yet another aspect of the present invention includes an apparatus for determining flow characteristics of a fluid flowing through a casing string in a wellbore, comprising a casing string comprising a downhole deployment valve; and at least one optical sensor coupled to the casing string for sensing at least one of a volumetric phase fraction of the fluid or a flow rate of the fluid through the casing string.

In yet another aspect, the design of circuitry, selection of sensors, and data communication is not limited to use with and within downhole deployment valves. All aspects of downhole instrumentation can be varied and tailored for others applications such as improving communication between surface units and measurement while drilling (MWD) tools, pressure while drilling (PWD) tools, and expandable sand screens (ESS).

DETAILED DESCRIPTION OF A PREFERRED EMBODIMENT

Placement of one or more seismic sensors on the outside of a casing string reduces the inherent fluid interference and casing string interference with signals which occurs when the seismic sensors are present within the casing string on the production tubing and also increases the proximity of the seismic sensors to the formation, thus allowing provision of more accurate signals and the simplifying of coupling means of the seismic sensors to the formation. Substantially accurate real time measurements of seismic conditions and other parameters are thus advantageously possible during all wellbore operations with the present invention. With the present invention, permanent seismic monitoring upon placement of the casing string within the wellbore allows for accurate measurements of seismic conditions before and after production tubing is inserted into the wellbore.

Sensors with Downhole Deployment Valves

Figure 1:
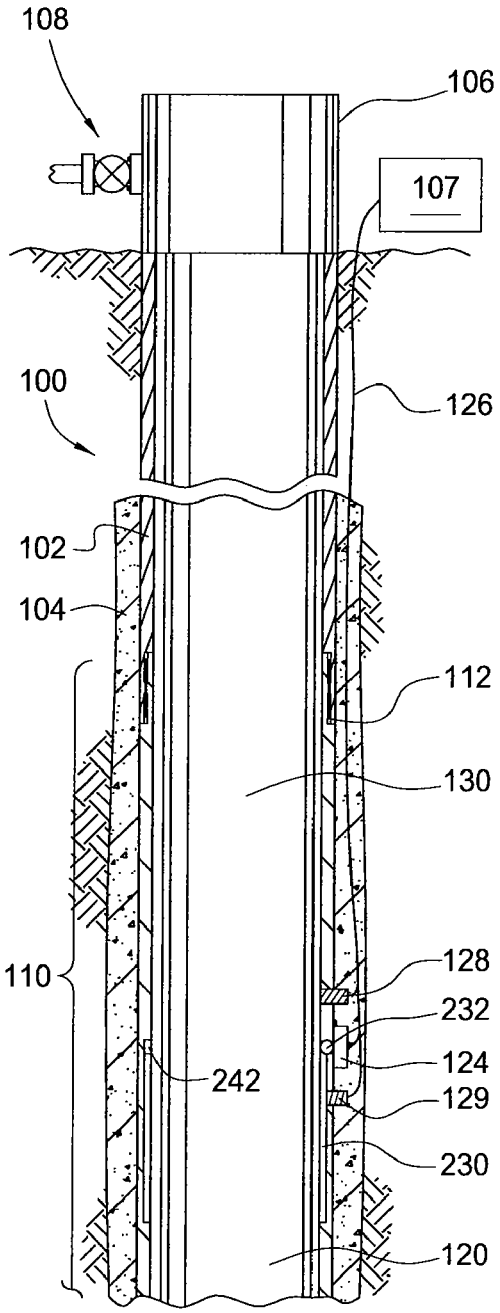
FIG. 1 is a section view of a wellbore having a casing string therein, the casing string including a downhole deployment valve (DDV).

FIG. 1 is a section view of a wellbore 100 with a casing string 102 disposed therein and held in place by cement 104. The casing string 102 extends from a surface of the wellbore 100 where a wellhead 106 would typically be located along with some type of valve assembly 108 which controls the flow of fluid from the wellbore 100 and is schematically shown. Disposed within the casing string 102 is a downhole deployment valve (DDV) 110 that includes a housing 112, a flapper 230 having a hinge 232 at one end, and a valve seat 242 in an inner diameter of the housing 112 adjacent the flapper 230. Alternatively, the flapper 230 may be replaced by a ball (not shown). As stated herein, the DDV 110 is an integral part of the casing string 102 and is run into the wellbore 100 along with the casing string 102 prior to cementing. The housing 112 protects the components of the DDV 110 from damage during run in and cementing. Arrangement of the flapper 230 allows it to close in an upward fashion wherein pressure in a lower portion 120 of the wellbore will act to keep the flapper 230 in a closed position. The DDV 110 also includes a surface monitoring and control unit (SMCU) 107 to permit the flapper 230 to be opened and closed remotely from the surface of the well. As schematically illustrated in FIG. 1, the attachments connected to the SMCU 107 include some mechanical-type actuator 124 and a control line 126 that can carry hydraulic fluid and/or electrical currents. Clamps (not shown) can hold the control line 126 next to the casing string 102 at regular intervals to protect the control line 126.

Also shown schematically in FIG. 1 is an upper sensor 128 placed in an upper portion 130 of the wellbore and a lower sensor 129 placed in the lower portion 120 of the wellbore. The upper sensor 128 and the lower sensor 129 can determine a fluid pressure within an upper portion 130 and a lower portion 120 of the wellbore, respectively. Similar to the upper and lower sensors 128, 129 shown, additional sensors (not shown) can be located in the housing 112 of the DDV 110 to measure any wellbore condition or parameter such as a position of the sleeve 226, the presence or absence of a drill string, and wellbore temperature. The additional sensors can determine a fluid composition such as an oil to water ratio, an oil to gas ratio, or a gas to liquid ratio. Furthermore, the additional sensors can detect and measure a seismic pressure wave from a source located within the wellbore, within an adjacent wellbore, or at the surface. Therefore, the additional sensors can provide real time seismic information.

Figure 2A:
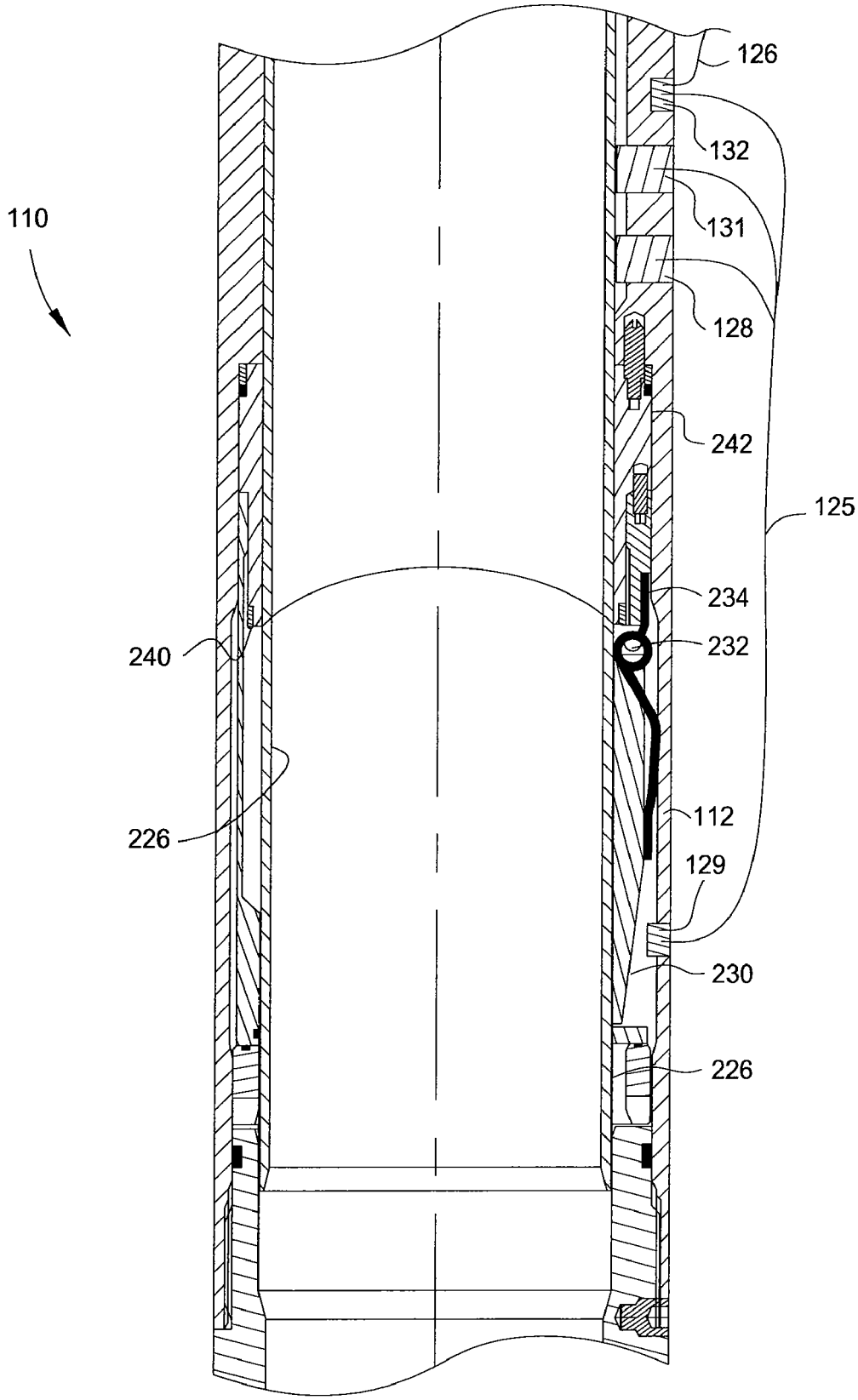
FIG. 2A is an enlarged view showing the DDV in greater detail.

FIG. 2A is an enlarged view of a portion of the DDV 110 showing the flapper 230 and a sleeve 226 that keeps it in an open position. In the embodiment shown, the flapper 230 is initially held in an open position by the sleeve 226 that extends downward to cover the flapper 230 and to ensure a substantially unobstructed bore through the DDV 110. A sensor 131 detects an axial position of the sleeve 226 as shown in FIG. 2A and sends a signal through the control line 126 to the SMCU 107 that the flapper 230 is completely open. All sensors such as the sensors 128, 129, 131 shown in FIG. 2A connect by a cable 125 to circuit boards 132 located downhole in the housing 112 of the DDV 110. Power supply to the circuit boards 132 and data transfer from the circuit boards 132 to the SMCU 107 is achieved via an electric conductor in the control line 126. Circuit boards 132 have free channels for adding new sensors depending on the need. The sensors 128, 129, 131 may be optical sensors, as described below.

Figure 2B:
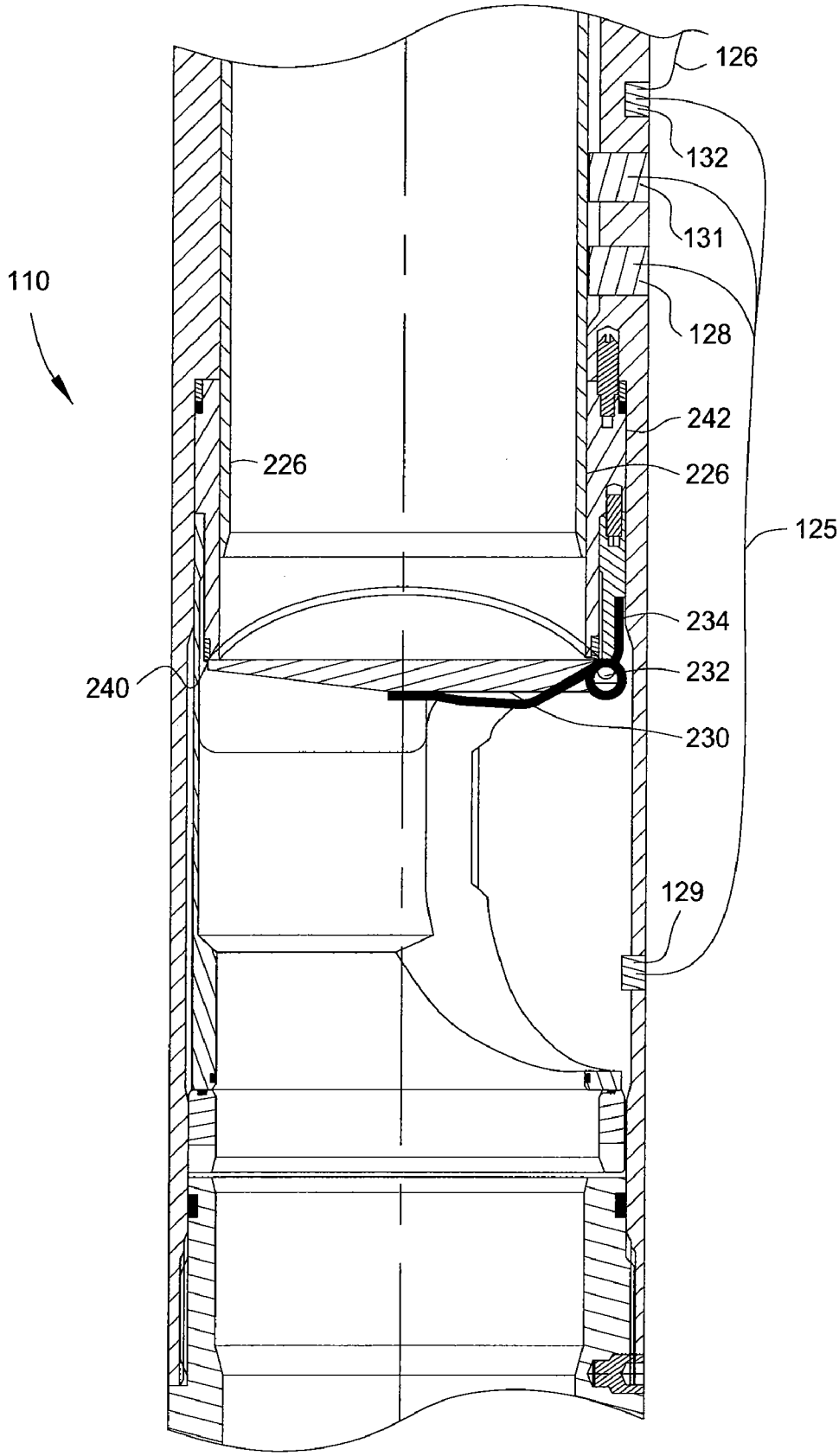
FIG. 2B is an enlarged view showing the DDV in a closed position.

FIG. 2B is a section view showing the DDV 110 in a closed position. A flapper engaging end 240 of a valve seat 242 in the housing 112 receives the flapper 230 as it closes. Once the sleeve 226 axially moves out of the way of the flapper 230 and the flapper engaging end 240 of the valve seat 242, a biasing member 234 biases the flapper 230 against the flapper engaging end 240 of the valve seat 242. In the embodiment shown, the biasing member 234 is a spring that moves the flapper 230 along an axis of a hinge 232 to the closed position. Common known methods of axially moving the sleeve 226 include hydraulic pistons (not shown) that are operated by pressure supplied from the control line 126 and interactions with the drill string based on rotational or axially movements of the drill string. The sensor 131 detects the axial position of the sleeve 226 as it is being moved axially within the DDV 110 and sends signals through the control line 126 to the SMCU 107. Therefore, the SMCU 107 reports on a display a percentage representing a partially opened or closed position of the flapper 230 based upon the position of the sleeve 226.

Figure 3:
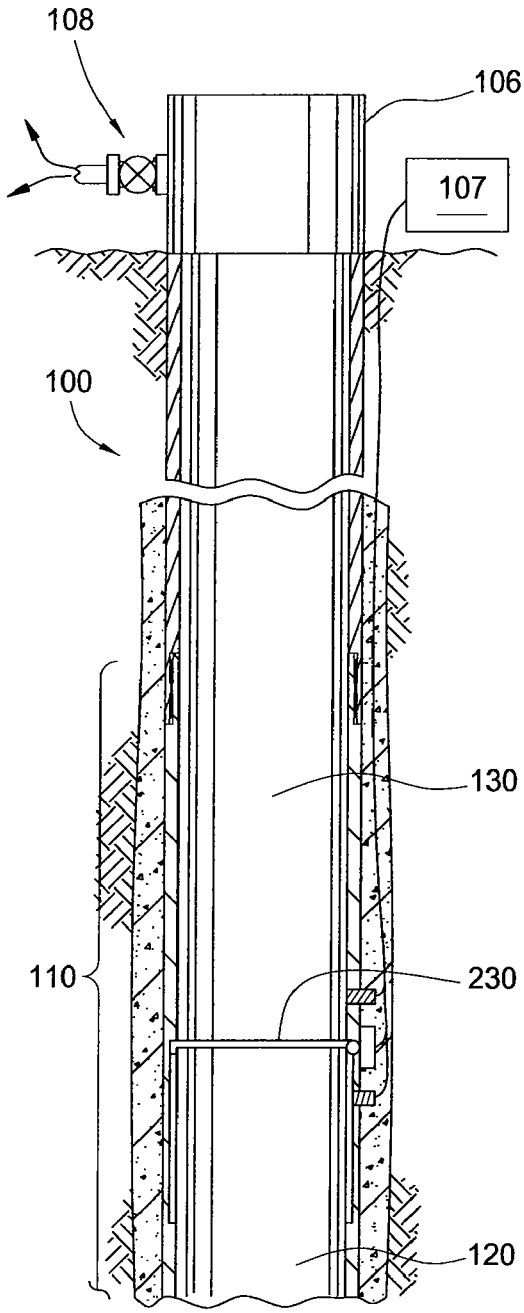
FIG. 3 is a section view of the wellbore showing the DDV in a closed position.

FIG. 3 is a section view showing the wellbore 100 with the DDV 110 in the closed position. In this position the upper portion 130 of the wellbore 100 is isolated from the lower portion 120 and any pressure remaining in the upper portion 130 can be bled out through the valve assembly 108 at the surface of the well as shown by arrows. With the upper portion 130 of the wellbore free of pressure the wellhead 106 can be opened for safely performing operations such as inserting or removing a string of tools.

Figure 4:
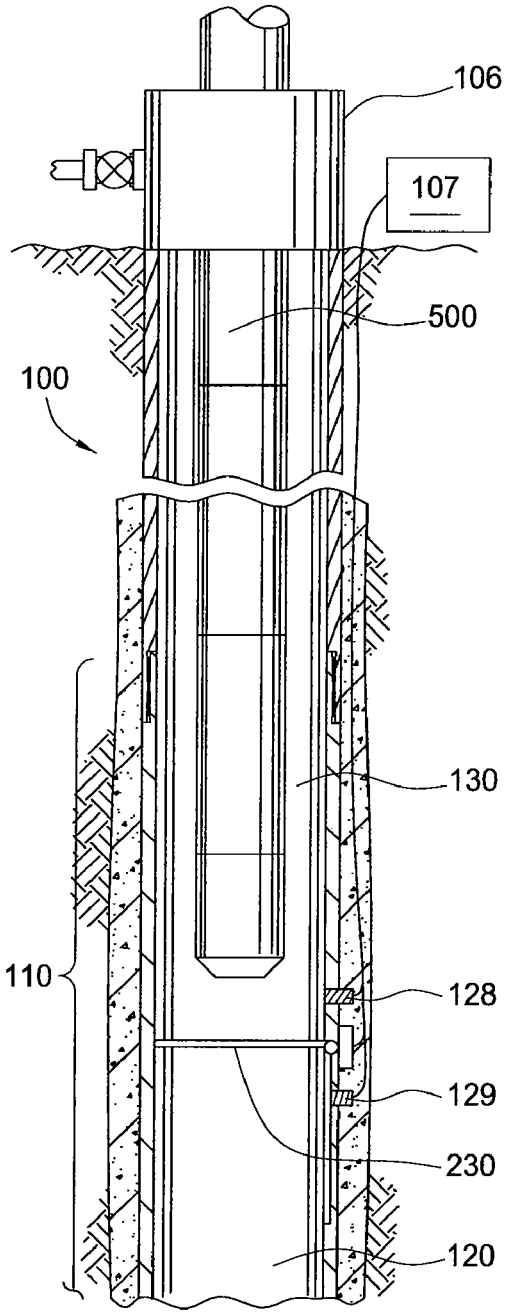
FIG. 4 is a section view of the wellbore showing a string of tools inserted into an upper portion of the wellbore with the DDV in the closed position.
Figure 5:
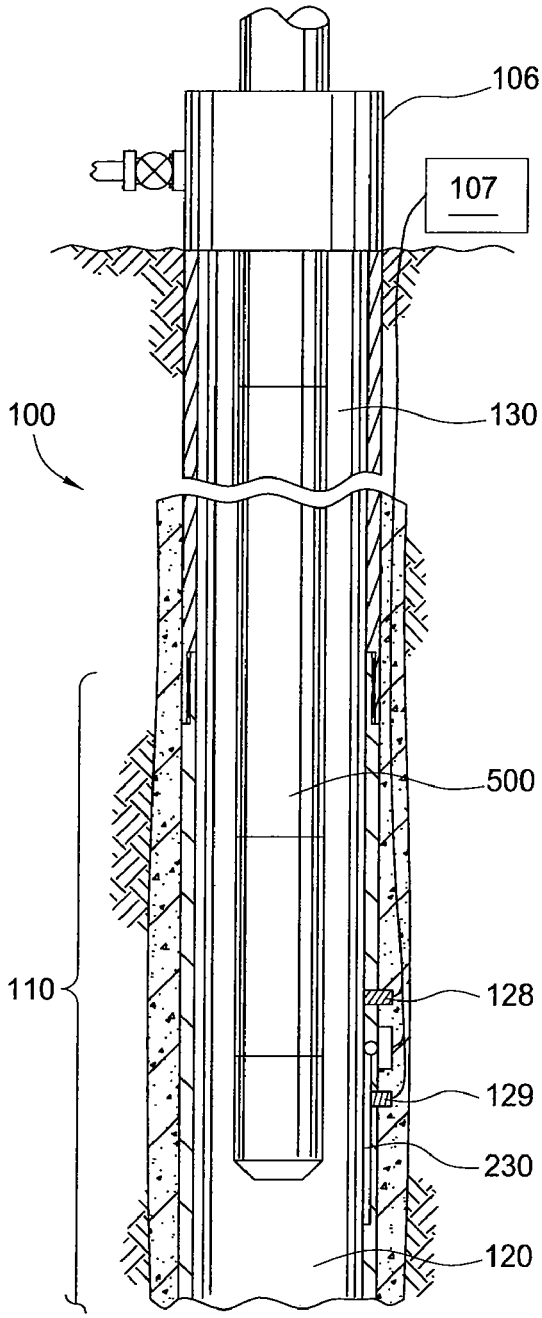
FIG. 5 is a section view of the wellbore with the string of tools inserted and the DDV opened.

FIG. 4 is a section view showing the wellbore 100 with the wellhead 106 opened and a string of tools 500 having been instated into the upper portion 130 of the wellbore. The string of tools 500 can include apparatus such as bits, mud motors, measurement while drilling devices, rotary steering devices, perforating systems, screens, and/or slotted liner systems. These are only some examples of tools that can be disposed on a string and instated into a well using the method and apparatus of the present invention. Because the height of the upper portion 130 is greater than the length of the string of tools 500, the string of tools 500 can be completely contained in the upper portion 130 while the upper portion 130 is isolated from the lower portion 120 by the DDV 110 in the closed position. Finally, FIG. 5 is an additional view of the wellbore 100 showing the DDV 110 in the open position and the string of tools 500 extending from the upper portion 130 to the lower portion 120 of the wellbore. In the illustration shown, a device (not shown) such as a stripper or rotating head at the wellhead 106 maintains pressure around the tool string 500 as it enters the wellbore 100.

Prior to opening the DDV 110, fluid pressures in the upper portion 130 and the lower portion 120 of the wellbore 100 at the flapper 230 in the DDV 110 must be equalized or nearly equalized to effectively and safely open the flapper 230. Since the upper portion 130 is opened at the surface in order to insert the tool string 500, it will be at or near atmospheric pressure while the lower portion 120 will be at well pressure. Using means well known in the art, air or fluid in the top portion 130 is pressurized mechanically to a level at or near the level of the lower portion 120. Based on data obtained from sensors 128 and 129 and the SMCU 107, the pressure conditions and differentials in the upper portion 130 and lower portion 120 of the wellbore 100 can be accurately equalized prior to opening the DDV 110.

Figure 6:
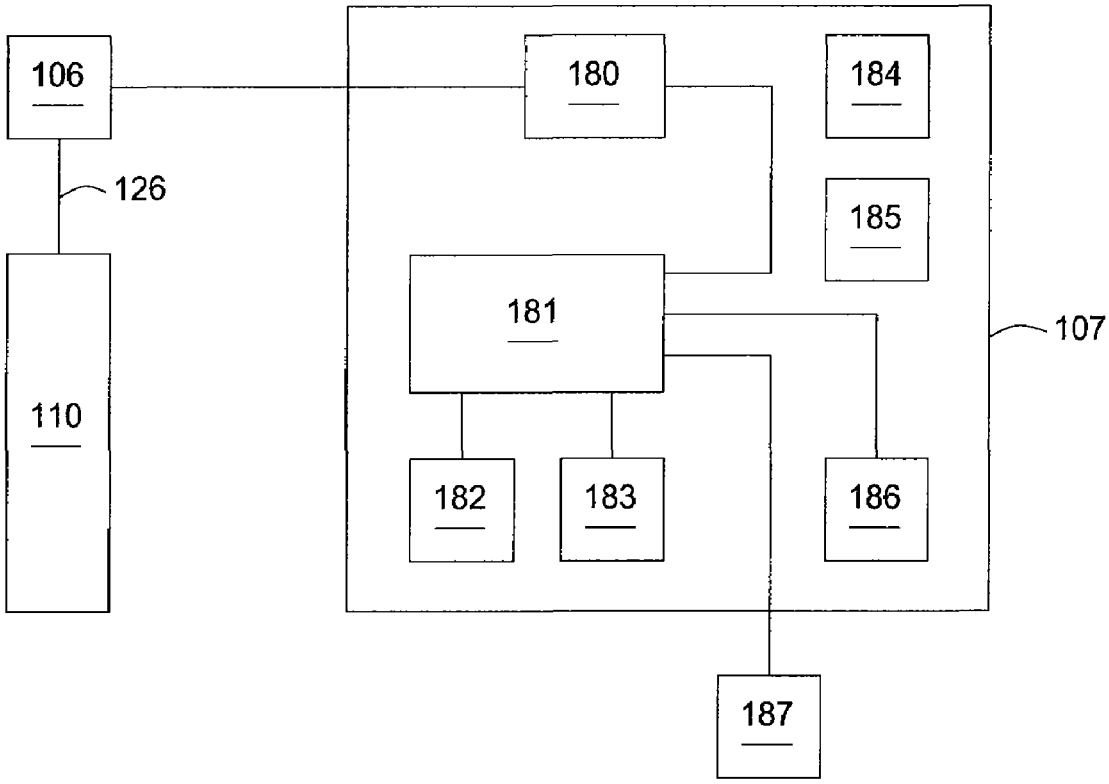
FIG. 6 is a schematic diagram of a control system and its relationship to a well having a DDV or an instrumentation sub that is wired with sensors

While the instrumentation such as sensors, receivers, and circuits is shown as an integral part of the housing 112 of the DDV 110 (See FIG. 2A) in the examples, it will be understood that the instrumentation could be located in a separate "instrumentation sub" located in the casing string. As shown in FIG. 6, the instrumentation sub can be hard wired to a SMCU 107 in a manner similar to running a hydraulic dual line control (HDLC) cable 126 from the instrumentation of the DDV 110. Therefore, the instrumentation sub utilizes sensors, receivers, and circuits as described herein without utilizing the other components of the DDV 110 such as a flapper and a valve seat.

FIG. 6 is a schematic diagram of a control system and its relationship to a well having a DDV 110 or an instrumentation sub that is wired with sensors (also indicated by 110) as disclosed herein. Shown in FIG. 1 is the wellbore having the DDV 110 disposed therein with the electronics necessary to operate the sensors discussed above (see FIG. 1).

A conductor embedded in a control line which is shown in FIG. 6 as the hydraulic dual line control (HDLC) cable 126 provides communication between downhole sensors and/or receivers and a surface monitoring and control unit (SMCU) 107. The HDLC cable 126 extends from the DDV 110 outside of the casing string 102 (see FIG. 1) containing the DDV 110 to an interface unit 180 of the SMCU 107. The SMCU 107 can include a hydraulic pump 185 and a series of valves utilized in operating the DDV 110 by fluid communication through the HDLC 126 and in establishing a pressure above the DDV 110 substantially equivalent to the pressure below the DDV 110. In addition, the SMCU 107 can include a programmable logic controller (PLC) based system 181 for monitoring and controlling each valve and other parameters, circuitry for interfacing with downhole electronics, an onboard display 186, and standard RS-232 interfaces (not shown) for connecting external devices. In this arrangement, the SMCU 107 outputs information obtained by the sensors and/or receivers 182 in the wellbore 100 to the display 186 or to the controls 183. Using the arrangement illustrated, the pressure differential between the upper portion and the lower portion of the wellbore 100 can be monitored and adjusted to an optimum level for opening the valve. In addition to pressure information near the DDV 110, the system can also include proximity sensors that describe the position of the sleeve 226 in the valve that is responsible for retaining the valve in the open position. By ensuring that the sleeve 226 is entirely in the open or the closed position, the valve can be operated more effectively. The SMCU 107 may further include a power supply 184 for providing power to operate the SMCU 107. A separate computing device such as a laptop 187 can optionally be connected to the SMCU 107.

Figure 7:
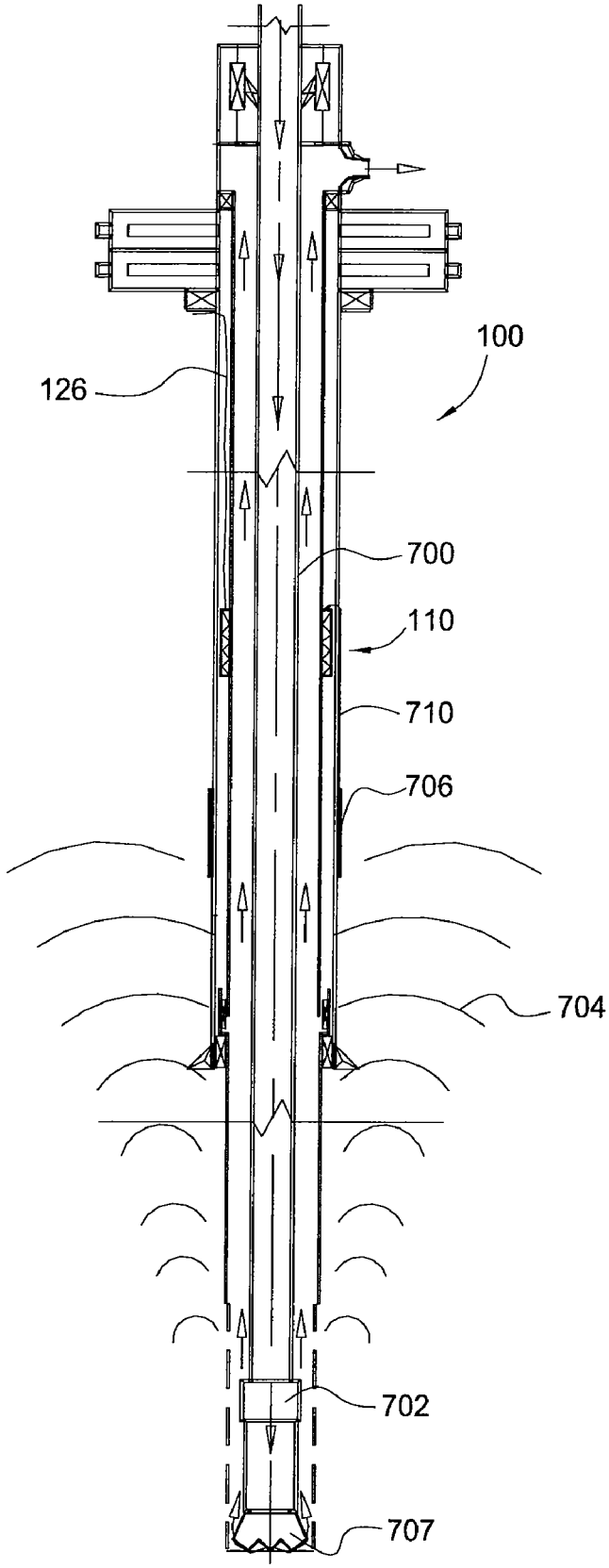
FIG. 7 is a section view of a wellbore showing the DDV of the present invention in use with a telemetry tool.

FIG. 7 is a section view of a wellbore 100 with a string of tools 700 that includes a telemetry tool 702 inserted in the wellbore 100. The telemetry tool 702 transmits the readings of instruments to a remote location by means of radio waves or other means. In the embodiment shown in FIG. 7, the telemetry tool 702 uses electromagnetic (EM) waves 704 to transmit downhole information to a remote location, in this case a receiver 706 located in or near a housing of a DDV 110 instead of at a surface of the wellbore. Alternatively, the DDV 110 can be an instrumentation sub that comprises sensors, receivers, and circuits, but does not include the other components of the DDV 110 such as a valve. The EM wave 704 can be any form of electromagnetic radiation such as radio waves, gamma rays, or x-rays. The telemetry tool 702 disposed in the tubular string 700 near the bit 707 transmits data related to the location and face angle of the bit 707, hole inclination, downhole pressure, and other variables. The receiver 706 converts the EM waves 704 that it receives from the telemetry tool 702 to an electric signal, which is fed into a circuit in the DDV 110 via a short cable 710. The signal travels to the SMCU via a conductor in a control line 126. Similarly, an electric signal from the SMCU can be sent to the DDV 110 that can then send an EM signal to the telemetry tool 702 in order to provide two way communication. By using the telemetry tool 702 in connection with the DDV 110 and its preexisting control line 126 that connects it to the SMCU at the surface, the reliability and performance of the telemetry tool 702 is increased since the EM waves 704 need not be transmitted through formations as far. Therefore, embodiments of this invention provide communication with downhole devices such as telemetry tool 702 that are located below formations containing an EM barrier. Examples of downhole tools used with the telemetry tool 702 include a measurement while drilling (MWD) tool or a pressure while drilling (PWD) tool.

Expandable Sand Screens

Still another use of the apparatus and methods of the present invention relate to the use of an expandable sand screen or ESS and real time measurement of pressure required for expanding the ESS. Using the apparatus and methods of the current invention with sensors incorporated in an expansion tool and data transmitted to a SMCU 107 (see FIG. 6) via a control line connected to a DDV or instrumentation sub having circuit boards, sensors, and receivers within, pressure in and around the expansion tool can be monitored and adjusted from a surface of a wellbore. In operation, the DDV or instrumentation sub receives a signal similar to the signal described in FIG. 7 from the sensors incorporated in the expansion tool, processes the signal with the circuit boards, and sends data relating to pressure in and around the expansion tool to the surface through the control line. Based on the data received at the surface, an operator can adjust a pressure applied to the ESS by changing a fluid pressure supplied to the expansion tool.

Optical Sensors with Downhole Deployment Valves

Figure 8:
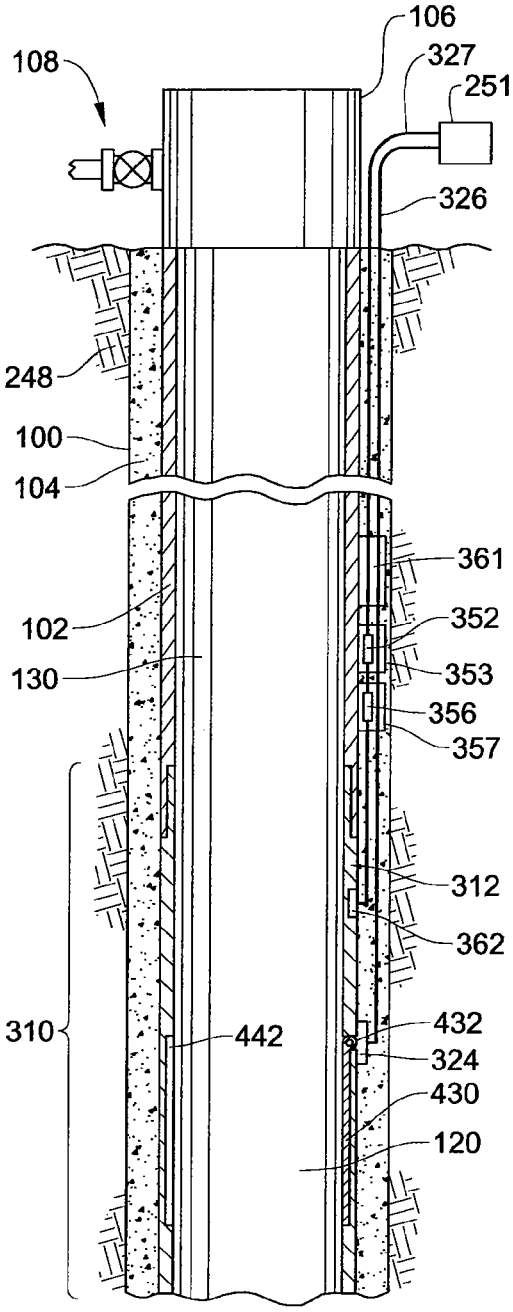
FIG. 8 is a section view of a wellbore having a casing string therein, the casing string including a downhole deployment valve (DDV) in an open position with a seismic sensor disposed on the outside of the casing string.

FIG. 8 shows an alternate embodiment of the present invention, depicting a section view of the casing string 102 disposed within the wellbore 100 and set therein by cement 104. As in FIG. 1, the casing string 102 extends from the surface of the wellbore 100 from within the wellhead 106 with the valve assembly 108 for controlling the flow of fluid from the wellbore 100. A downhole deployment valve (DDV) 310 is disposed within the casing string 102 and is an integral part of the casing string 102. The DDV 310 includes a housing 312, a flapper 430 having a hinge 432 at one end, and a valve seat 442 formed within the inner diameter of the housing 312 adjacent the flapper 430. The flapper 430, hinge 432, and valve seat 442 operate in the same fashion and possess the same characteristics as the flapper 230, hinge 232, and valve seat 242 of FIGS. 1-6, so the above description of the operation and characteristics of the components applies equally to the embodiments of FIGS. 8-12.

Specifically, the flapper 430 is used to separate the upper portion of the wellbore 130 from the lower portion of the wellbore 120 at various stages of the operation. A sleeve 226 (see FIG. 2A) is used to keep the flapper 430 in an open position by extending downward to cover the flapper 230 and ensure a substantially unobstructed bore through the DDV 310.

Located within the housing 312 of the DDV 310 is an optical sensor 362 for measuring conditions or parameters within a formation 248 or the wellbore, such as temperature, pressure, seismic conditions, acoustic conditions, and/or fluid composition in the formation 248, including oil to water ratio, oil to gas ratio, or gas to liquid ratio. The optical sensor 362 may comprise any suitable type of optical sensing elements, such as those described in U.S. Pat. No. 6,422,084, which is herein incorporated by reference in its entirety. For example, the optical sensor 362 may comprise an optical fiber, having the reflective element embedded therein; and a tube, having the optical fiber and the reflective element encased therein along a longitudinal axis of the tube, the tube being fused to at least a portion of the fiber. Alternatively, the optical sensor 362 may comprise a large diameter optical waveguide having an outer cladding and an inner core disposed therein.

The optical sensor 362 may include a pressure sensor, temperature sensor, acoustic sensor, seismic sensor, or other sonde or sensor which takes temperature or pressure measurements. In one embodiment, the optical sensor 362 is a seismic sensor. The seismic sensor 362 detects and measures seismic pressure acoustic waves 401, 411, 403, 501, 511, 503, 601, 611, 603 in FIGS. 10-12) emitted by a seismic source 371, 471, 571 located within the wellbore 100 in a location such as a drill string 305 (see FIG. 10), at the surface of the wellbore 100 (see FIG. 11), or in a proximate wellbore 700 (see FIG. 12). The operation and construction of a Bragg grating sensor which may be utilized with the present invention as the seismic sensor is described in commonly-owned U.S. Pat. No. 6,072,567, entitled "Vertical Seismic Profiling System Having Vertical Seismic Profiling Optical Signal Processing Equipment and Fiber Bragg Grafting Optical Sensors", issued Jun. 6, 2000, which is herein incorporated by reference in its entirety.

Construction and operation of an optical sensors suitable for use with the present invention, in the embodiment of an FBG sensor, is described in the U.S. Pat. No. 6,597,711 issued on Jul. 22, 2003 and entitled "Bragg Grating-Based Laser", which is herein incorporated by reference in its entirety. Each Bragg grating is constructed so as to reflect a particular wavelength or frequency of light propagating along the core, back in the direction of the light source from which it was launched. In particular, the wavelength of the Bragg grating is shifted to provide the sensor.

Another suitable type of optical sensor for use with the present invention is an FBG-based inferometric sensor. An embodiment of an FBG-based inferometric sensor which may be used as the optical sensor 362 of the present invention is described in U.S. Pat. No. 6,175,108 issued on Jan. 16, 2001 and entitled "Accelerometer featuring fiber optic bragg grating sensor for providing multiplexed multi-axis acceleration sensing", which is herein incorporated by reference in its entirety. The inferometric sensor includes two FBG wavelengths separated by a length of fiber. Upon change in the length of the fiber between the two wavelengths, a change in arrival time of light reflected from one wavelength to the other wavelength is measured. The change in arrival time indicates the wellbore or formation parameter.

The DDV 310 also includes a surface monitoring and control unit (SMCU) 251 to permit the flapper 430 to be opened and closed remotely from the well surface. The SMCU 251 includes attachments of a mechanical-type actuator 324 and a control line 326 for carrying hydraulic fluid and/or electrical currents. The SMCU 251 processes and reports on a display seismic information gathered by the seismic sensor 362.

An optical line 327 is connected at one end to the optical sensor 362 and at the other end to the SMCU 251, which may include a processing unit for converting the signal transmitted through the optical line 327 into meaningful data. The optical line 327 is in optical communication with the optical sensor 362 as well as the SMCU 251 having optical signal processing equipment. One or more control line protectors 361 are located on the casing string 102 to house and protect the control line 326 as well as the optical line 327.

Any number of additional seismic sensors 352 (or any other type of optical sensor such as pressure sensor, temperature sensor, acoustic sensor, etc.), may be located on the casing string 102 at intervals above the seismic sensor 362 to provide additional locations to which the seismic source 371, 471, 571 may transmit acoustic waves (not shown). When using the additional seismic sensors 352, 356, the optical line 327 is run through the seismic sensors 352, 356 on its path from the seismic sensor 362 to the SMCU 251. Seismic sensor carriers 353, 357 (e.g., metal tubes) may be disposed around the seismic sensors 352, 356 to protect the seismic sensors 353, 356 as well as the control line 326 and optical line 327.

Measuring While Drilling

Figure 9:
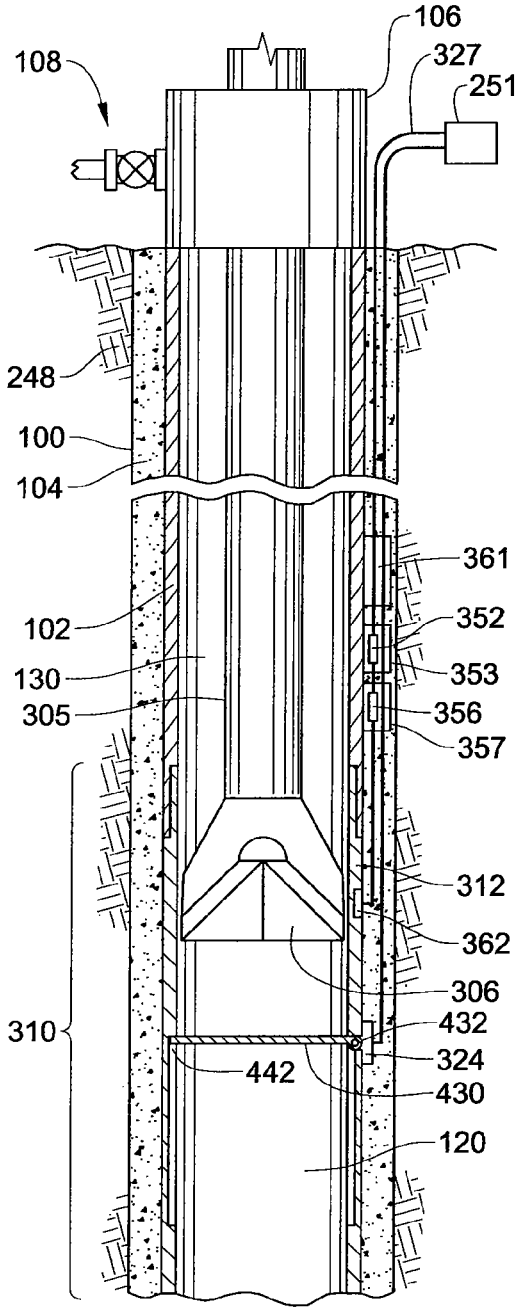
FIG. 9 is a section view of the wellbore showing a drill string inserted into an upper portion of the wellbore with the DDV in the closed position.

FIG. 9 shows the flapper 430 in the closed position, the wellhead 106 opened, and a drill string 305 inserted into the wellbore 100. The drill string 305 is a string of tubulars or a string of tools with an earth removal member 306 operatively attached to its lower end. A flapper engaging end 240 (see FIG. 2A) of a valve seat 442 in the housing 312 is located opposite the flapper 430. In the position of the flapper 430 depicted in FIG. 9, a biasing member 234 (see FIG. 2A) biases the flapper 430 against the valve seat 442. In the embodiment shown in FIG. 2A, the biasing member 234 is a spring.

Figure 10:
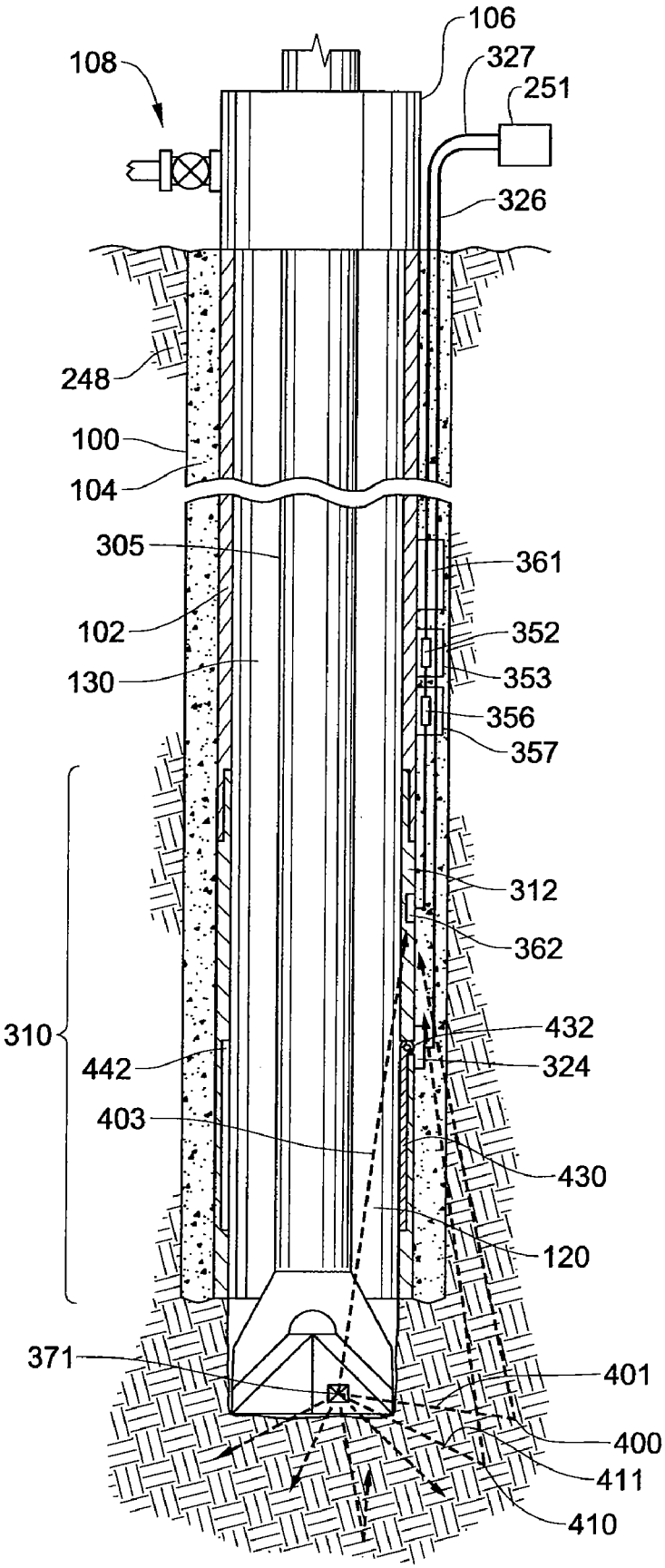
FIG. 10 is a section view of the wellbore with the drill string inserted and the DDV opened. A seismic source is located within the drill string.
Figure 11:
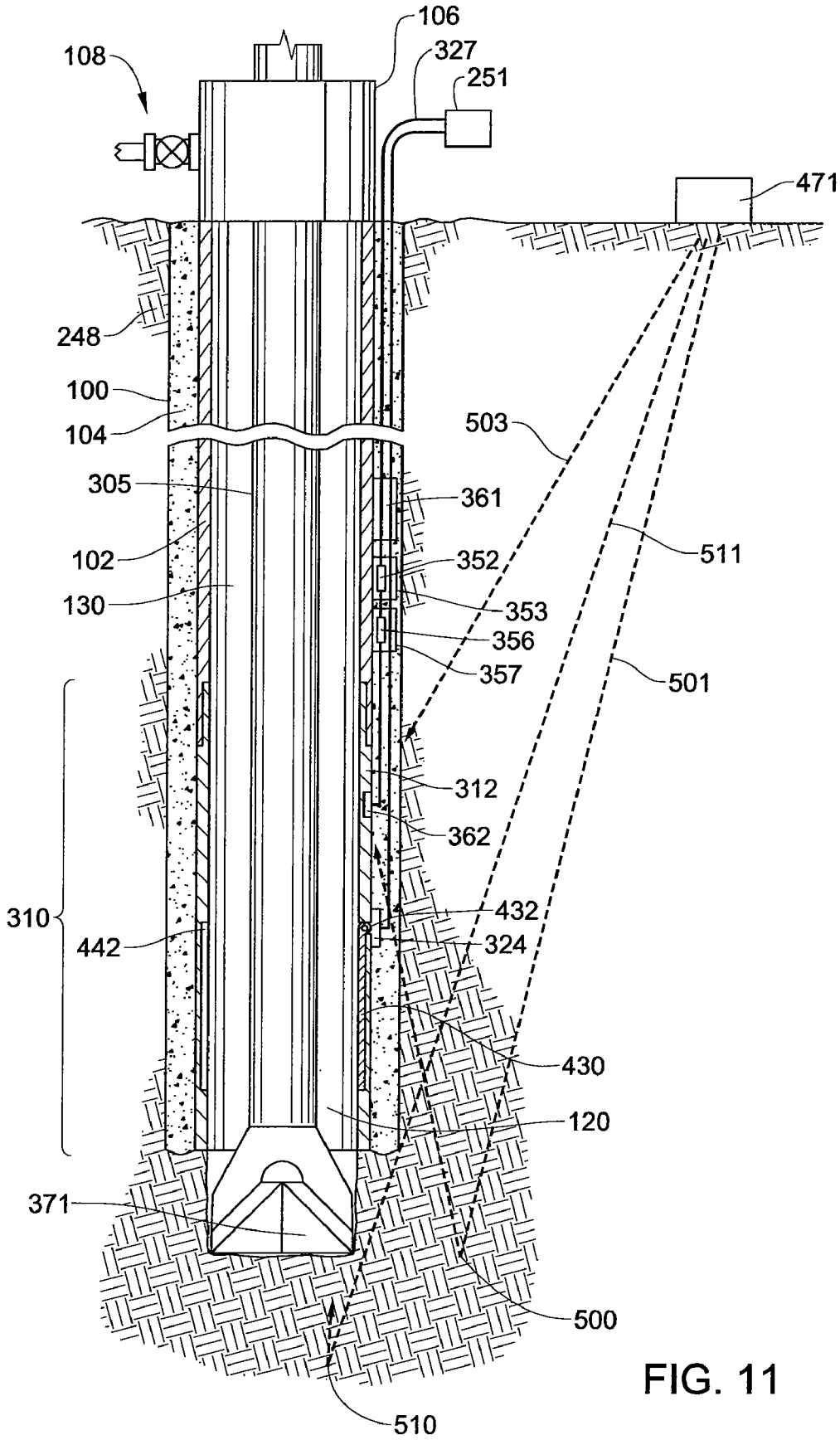
FIG. 11 is a section view of the wellbore with the drill string inserted and the DDV opened. A seismic source is located at a surface of the wellbore.
Figure 12:
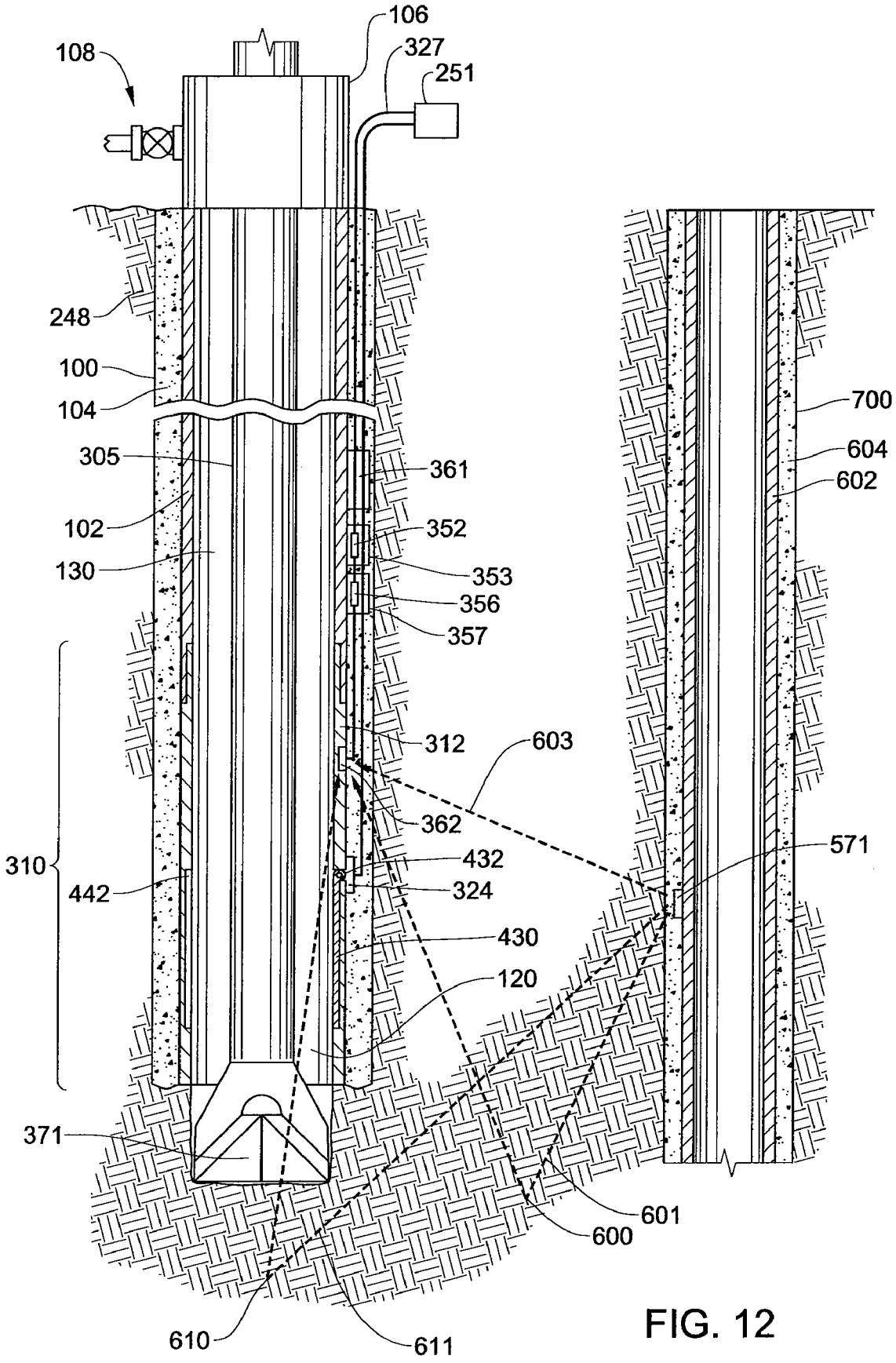
FIG. 12 is a section view of the wellbore with the drill string inserted and the DDV opened. A seismic source is located in a proximate wellbore.

FIGS. 10-12 show the DDV 310 in the open position and the drill string 305 extending from the upper portion 130 to the lower portion 120 of the wellbore 100. FIG. 10 shows a seismic source 371 located within the drill string 305, with acoustic waves 401 and 411 emitted from the seismic source 371 into the formation 248, then reflected or partially reflected from the formation 248 into the seismic sensor 362. Similarly, FIG. 11 shows a seismic source 471 located at the surface of the wellbore 100, with acoustic waves 501 and 511 emitted from the seismic source 471 into the formation 248, then reflected or partially reflected from the formation 248 into the seismic sensor 362. FIG. 12 shows a seismic source 571 located in a nearby wellbore 700, with acoustic waves 601 and 611 also emitted from the seismic source 571 into the formation 248, then reflected or partially reflected from the formation 248 into the seismic sensor 362. In an alternative embodiment, the vibration of the drill string 305 itself or another downhole tool may act as the seismic source when vibrating against the wellbore or the casing in the wellbore. The seismic sources 371, 471, and 571 in FIGS. 10-12 all transmit an acoustic wave 403, 503, or 603 directly to the seismic sensor 362 for calibration purposes.

In operation, the casing string 102 with the DDV 310 disposed thereon is lowered into the drilled-out wellbore 100 through the open wellhead 106 and cemented therein with cement 104. Initially, the flapper 430 is held in the open position by the sleeve 226 (see FIG. 2A) to provide an unobstructed wellbore 100 for fluid circulation during run-in of the casing string 102. FIG. 8 shows the casing string 102 and the DDV 310 cemented within the wellbore 100 with the flapper 430 in the open position.

When it is desired to run the drill string 305 into the wellbore 100 to drill to a further depth within the formation 248, the flapper 430 is closed. The drill string 305 is inserted into the wellhead 106. FIG. 9 shows the flapper valve 430 closed and the drill string 305 inserted into the wellbore 100.

The wellhead 106 is then closed to atmospheric pressure from the surface. The DDV 310 flapper 430 is opened. The drill string 305 is then lowered into the lower portion 120 of the wellbore 100 and then further lowered to drill into the formation 248. FIGS. 10-12 depict three different configurations for transmission of formation conditions to the surface while the drill string 305 is drilling into the formation 248. Formation conditions may also be transmitted to the SMCU 251 before or after the drill string 305 drills into the formation.

In FIG. 10, while the drill string 305 is drilling into the formation 248, the seismic source 371 transmits acoustic wave 401, which bounces from location 400 in the formation 248 to the seismic sensor 362. Alternatively, the seismic source may be activated when the drill string 305 is stationary (not drilling), e.g., by forcing fluid through the drill string through a converter that emits acoustic energy. The seismic source 371 also transmits acoustic wave 411, which bounces from location 410 in the formation 248 to the seismic sensor 362. The seismic source 371 also transmits acoustic wave 403, which travels directly to the seismic sensor 362. The direct transmission of the acoustic wave 403 is necessary to process the gathered information and interpret the final image by deriving the distance between the drill bit and the seismic sensor 362 plus the travel time to calibrate the acoustic waves 401 and 411. Because the acoustic waves 401 and 411 must travel to the formation 248, then to the seismic sensor 362, a time delay exists. To offset the acoustic waves 401 and 411 with the delay in time, the direct acoustic wave 403 may be measured with no time delay caused by bouncing off the formation 248. The additional seismic sensors 352 and 356 on the outside of the casing string 102 may also receive acoustic waves (not shown) which are bounced from the formation 248 at different locations. Any number of acoustic waves may be emitted by each seismic source 371, 352, 356 at any angle with respect to the formation 248 and to any location within the formation 248. Additional acoustic waves are shown emitted from the seismic source 371 at varying angles to varying locations.

After the acoustic waves 401, 411, and 403 (and any acoustic waves from the additional seismic sensors 352 and 356) are transmitted into the formation 248 by the seismic source 371 and then reflected or partially reflected to the seismic sensor 362, the gathered information is transmitted through the optical cable 327 to the SMCU 251. The SMCU 251 processes the information received through the optical cable 327. The operator may read the information outputted by the SMCU 251 and adjust the position and drilling direction or drilling trajectory of the drill string 305, the composition of the drilling fluid introduced through the drill string 305, and other parameters during drilling. In the alternative, the data may be interpreted off-site at a data processing center.

FIG. 11 shows an alternate embodiment of the present invention. In this embodiment, vertical seismic profiling ahead of the earth removal member 306 of the drill string 305 is performed by a seismic source 471 emitted from the surface of the wellbore 100, rather than from the earth removal member 306. The seismic source 471 emits acoustic wave 501, which bounces from the formation 248 at location 500 to the seismic sensor 362. Also, the seismic source 471 emits acoustic wave 511, which bounces from the formation 248 at location 510 to the seismic sensor 362. As well, the seismic source 471 emits acoustic wave 503, which travels through a direct path to the seismic sensor 362 without bouncing from the formation 248. Acoustic wave 503 is used for calibration purposes, as described above in relation to acoustic wave 403 of FIG. 10. The additional seismic sensors 352 and 356 on the outside of the casing string 102 may also receive acoustic waves (not shown) which are bounced from the formation 248 at different locations. Any number of acoustic waves may be emitted by each seismic source 471, 352, 356 at any angle with respect to the formation 248 and to any location within the formation 248 and transmitted to the seismic sensor 362. The information gathered by the seismic sensor 362 is transmitted to the SMCU 251 through the optical cable 327, and the rest of the operation is the same as the operation described in relation to FIG. 10.

FIG. 12 shows a further alternate embodiment of the present invention. Here, the seismic source 571 is emitted from a nearby wellbore 700. The wellbore 700 is shown with casing 602 cemented therein with cement 604. The seismic source 571 is shown located in the annular area between the casing 602 and the wellbore 700, but may be located anywhere within the nearby wellbore 700 for purposes of the present invention. Specifically, the seismic source 571 may be disposed on a tubular string (not shown) within the nearby wellbore 700, among other options. Similar to the operation of the embodiment of FIGS. 10-11, the seismic source 571 emits acoustic wave 601 into location 600 in the formation 248, which bounces off the formation 248 to the seismic sensor 362. The seismic source 571 emits acoustic wave 611 into location 610 in the formation 248, and the acoustic wave 611 bounces off the formation 248 into the seismic sensor 362. The acoustic wave 603 is transmitted directly from the seismic source 571 to the seismic sensor 362 for calibration purposes, as described above in relation to FIGS. 10-11. The additional seismic sensors 352 and 356 on the outside of the casing string 102 may also receive acoustic waves (not shown) which are bounced from the formation 248 at different locations. Any number of acoustic waves may be emitted by each seismic source 371, 352, 356 at any angle with respect to the formation 248 and to any location within the formation 248 for receiving by the seismic sensor 362. The information gathered by the seismic sensor 362 is transmitted to the SMCU 251 through the optical cable 327, and the rest of the operation is the same as the operation described in relation to FIG. 10.

In another aspect of the present invention, optical sensors may be utilized in embodiments of DDVs shown in FIGS. 1-6 to measure the differential pressure across the downhole deployment valve. An optical sensor may also be used to measure the position of the flapper valve of the downhole deployment valve. An FBG may be coupled with the flapper via a strain-inducing member such that movement of the flapper valve induces a strain on the FBG. The strain of the FBG may result in a change in the FBG wavelength indicative of the position of the flapper valve. The optical seismic, pressure, temperature, or acoustic sensors shown and described in relation to FIGS. 8-12 may also be utilized in combination with the optical sensors utilized in FIGS. 1-6 to measure differential pressure across the DDV.

Although the above descriptions of FIGS. 8-12 contemplated the use of a seismic sensor 362 within the DDV 310, an optical pressure sensor (not shown) or temperature sensor (not shown) may also be deployed with the DDV 310 of the above figures to measure temperature or pressure within the formation 248 or the wellbore 100. The present invention may be utilized in vertical or crosswell seismic profiling in 2D, 3D, or 4D, or continuous seismic monitoring, such as microseismic monitoring. VSP may be accomplished when the seismic source is located at the surface by moving the seismic source to accumulate the full image of the formation. Crosswell seismic profiling may be accomplished when the seismic source is located in an adjacent wellbore by moving the seismic source to accumulate a full image of the formation.

The embodiments depicted in FIGS. 8-12 may also be useful to calibrate surface seismic data after the casing string has been placed at a known depth within the wellbore. Furthermore, as described above, the present invention provides real time seismic data while drilling into the formation, including imaging ahead of the drill string and pore pressure prediction. The measurements from the acoustic waves sent to the SMCU may be utilized in geosteering to correlate the seismic image and update the seismic data initially obtained by the seismic survey to current conditions while drilling into the formation. Geosteering allows the operator to determine in what direction to steer the drill string to drill to the targeted portion of the formation. The information gathered by the seismic sensor may be placed into models to determine formation conditions in real time.

The above embodiments are also useful in performing acoustic monitoring while drilling into the formation, including monitoring the vibration of the drill string and/or the earth removal member against the casing in the wellbore, along with monitoring the vibration of other tools and downhole components against the casing within the wellbore, monitoring the acoustics of drilling fluids introduced into the drill string while drilling into the formation, and monitoring acoustics within an adjacent wellbore.

Embodiments of the present invention are not only useful in obtaining seismic data in real time, but may also provide monitoring of seismic conditions after the well has been drilled, including but not limited to microseismic monitoring and other acoustic monitoring during production of the hydrocarbons within the well. Microseismic monitoring allows the operator to detect, evaluate, and locate small fracture events related to production operations, such as those caused by the movement of hydrocarbon fluids or by the subsidence or compaction of the formation. After the well has been drilled, the present invention may also be utilized to obtain seismic information from an adjacent wellbore.

Flow Meter

Other parameters may be measured using optical sensors according to the present invention. A flow meter 875 may be included as part of the casing string 102 to measure volumetric fractions of individual phases of a multiphase mixture flowing through the casing string 102, as well as to measure flow rates of components in the multiphase mixture. Obtaining these measurements allows monitoring of the substances being removed from the wellbore while drilling, as described below.

Figure 13:
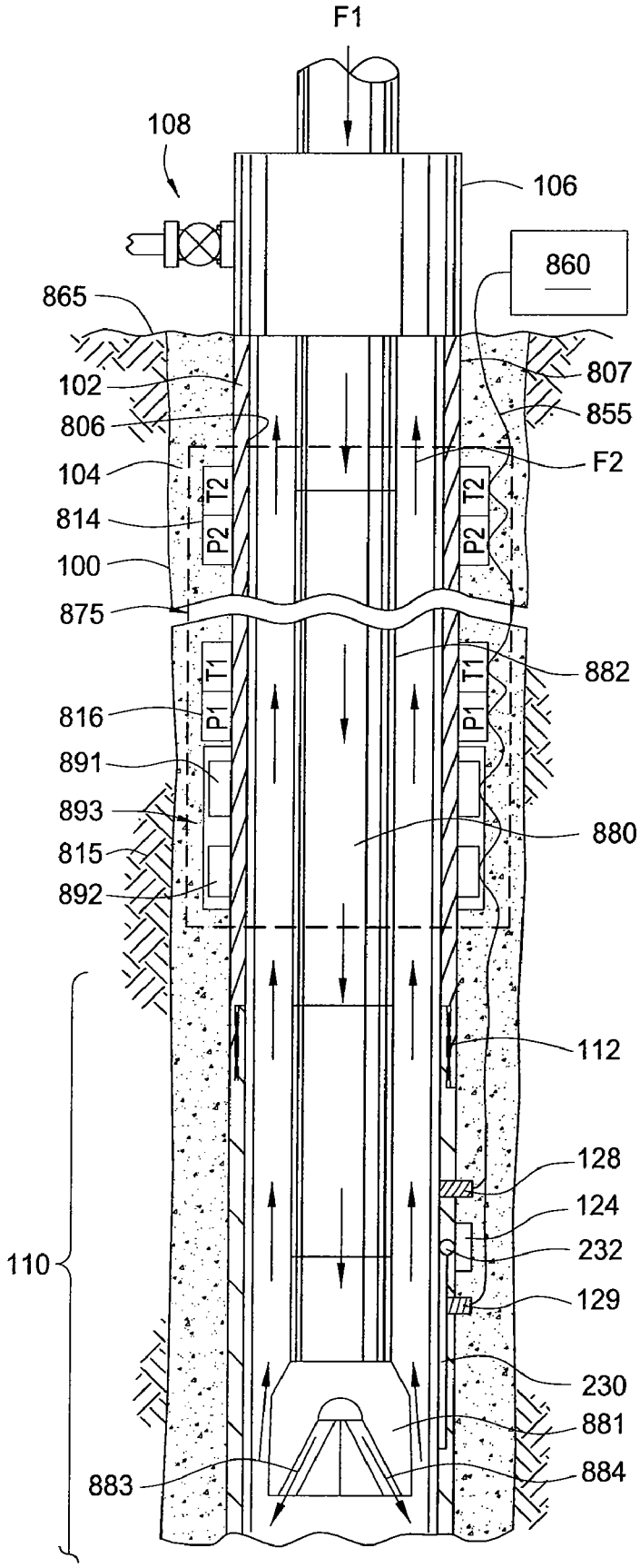
FIG. 13 is a cross-sectional view of the DDV of FIGS. 1-6 with a flow meter disposed in the casing string.

Specifically, when utilizing optical sensors as the upper and lower sensors 128 and 129 and additional sensors (not shown) to measure the position of sleeve 226 or other wellbore parameters as described in relation to FIGS. 1-6, a flow meter may be disposed within the casing string 102 above or below the DDV 110. In FIG. 13, the flow meter 875 is shown above the DDV 110. The DDV 110 has the same components and operates in the same manner as described above in relation to FIGS. 1-6, so like components are labeled with like numbers to FIGS. 1-6. The casing string 102, which has an inner surface 806 and an outer surface 807, is shown set within a wellbore 100 drilled out of a formation 815. The casing string 102 is set within the wellbore 100 by cement 104.

The wellhead 106 with the valve assembly 108 may be located at a surface 865 of the wellbore 100. Various tools, including a drill string 880 may be lowered through the wellhead 106. The drill string 880 includes a tubular 882 having an earth removal member 881 attached to its lower end. The earth removal member 881 has passages 883 and 884 therethrough for use in circulating drilling fluid F1 while drilling into the formation 815 (see below).

A SMCU 860, which is the same as the SMCU 251 of FIGS. 8-12 as well as the SMCU 107 of FIGS. 1-7, is also present at the surface 565. The SMCU 860 may include a light source, delivery equipment, and logic circuitry, including optical signal processing, as described above. An optical cable 855, which is substantially the same as the optical line 327 of FIGS. 8-12, is connected at one end to the SMCU 860.

The flow meter 875 may be substantially the same as the flow meter described in co-pending U.S. patent application Ser. No. 10/348,040, entitled "Non-Intrusive Multiphase Flow Meter" and filed on Jan. 21, 2003, which is herein incorporated by reference in its entirety. Other flow meters may also be useful with the present invention. The flow meter 875 allows volumetric fractions of individual phases of a multiphase mixture flowing through the casing string 102, as well as flow rates of individual phases of the multiphase mixture, to be found. The volumetric fractions are determined by using a mixture density and speed of sound of the mixture. The mixture density may be determined by direct measurement from a densitometer or based on a measured pressure difference between two vertically displaced measurement points (shown as P1 and P2) and a measured bulk velocity of the mixture, as described in the above-incorporated by reference patent application. Various equations are utilized to calculate flow rate and/or component fractions of the fluid flowing through the casing string 102 using the above parameters, as disclosed and described in the above-incorporated by reference application.

In one embodiment, the flow meter 875 may include a velocity sensor 891 and speed of sound sensor 892 for measuring bulk velocity and speed of sound of the fluid, respectively, up through the inner surface 806 of the casing string 102, which parameters are used in equations to calculate flow rate and/or phase fractions of the fluid. As illustrated, the sensors 891 and 892 may be integrated in single flow sensor assembly (FSA) 893. In the alternative, sensors 891 and 892 may be separate sensors. The velocity sensor 891 and speed of sound sensor 892 of FSA 893 may be similar to those described in commonly-owned U.S. Pat. No. 6,354,147, entitled "Fluid Parameter Measurement in Pipes Using Acoustic Pressures", issued Mar. 12, 2002 and incorporated herein by reference.

The flow meter 875 may also include combination pressure and temperature (P/T) sensors 814 and 816 around the outer surface 807 of the casing string 102, the sensors 814 and 816 similar to those described in detail in commonly-owned U.S. Pat. No. 5,892,860, entitled "Multi-Parameter Fiber Optic Sensor For Use In Harsh Environments", issued Apr. 6, 1999 and incorporated herein by reference. In the alternative, the pressure and temperature sensors may be separate from one another. Further, for some embodiments, the flow meter 875 may utilize an optical differential pressure sensor (not shown). The sensors 891, 892, 814, and/or 816 may be attached to the casing string 102 using the methods and apparatus described in relation to attaching the sensors 30, 130, 230, 330, 430 to the casing strings 5, 105, 205, 305, 405 of FIGS. 1-5 of co-pending U.S. patent application Ser. No. 10/676,376 entitled "Permanent Downhole Deployment of Optical Sensors", filed on Oct. 1, 2003, which is herein incorporated by reference in its entirety.

The optical cable 855, as described above in relation to FIGS. 8-12, may include one or more optical fibers to communicate with the sensors 891, 892, 814, 816. Depending on a specific arrangement, the optical sensors 891, 892, 814, 816 may be distributed on a common one of the fibers or distributed among multiple fibers. The fibers may be connected to other sensors (e.g., further downhole), terminated, or connected back to the SMCU 860. The flow meter 875 may also include any suitable combination of peripheral elements (e.g., optical cable connectors, splitters, etc.) well known in the art for coupling the fibers. Further, the fibers may be encased in protective coatings, and may be deployed in fiber delivery equipment, as is also well known in the art.

Embodiments of the flow meter 875 may include various arrangements of pressure sensors, temperature sensors, velocity sensors, and speed of sound sensors. Accordingly, the flow meter 875 may include any suitable arrangement of sensors to measure differential pressure, temperature, bulk velocity of the mixture, and speed of sound in the mixture. The methods and apparatus described herein may be applied to measure individual component fractions and flow rates of a wide variety of fluid mixtures in a wide variety of applications. Multiple flow meters 875 may be employed along the casing string 102 to measure the flow rate and/or phase fractions at various locations along the casing string 102.

For some embodiments, a conventional densitometer (e.g., a nuclear fluid densitometer) may be used to measure mixture density as illustrated in FIG. 2B of the above-incorporated application (Ser. No. 10/348,040) and described therein. However, for other embodiments, mixture density may be determined based on a measured differential pressure between two vertically displaced measurement points and a bulk velocity of the fluid mixture, also described in the above-incorporated application (Ser. No. 10/348,040).

In use, the flow meter 875 is placed within the casing string 102, e.g., by threaded connection to other casing sections. The wellbore 100 is drilled to a first depth with a drill string (not shown). The drill string is then removed. The casing string 102 is then lowered into the drilled-out wellbore 100. The cement 104 is introduced into the inner diameter of the casing string 102, then flows out through the lower end of the casing string 102 and up through the annulus between the outer surface 807 of the casing string 102 and the inner diameter of the wellbore 100. The cement 104 is allowed to cure at hydrostatic conditions to set the casing string 102 permanently within the wellbore 100.

From this point on, the flow meter 875 is permanently installed within the wellbore 100 with the casing string 102 and is capable of measuring fluid flow and component fractions present in the fluid flowing through the inner diameter of the casing string 102 during wellbore operations. Simultaneously, the DDV 110 operates as described above to open and close when the drill string 880 acts as the tool 500 (see FIGS. 1-6) which is inserted within the wellbore 100, and the optical sensors 128, 129, 131 may sense wellbore and formation conditions as well as position of the sleeve 226, as described above in relation to FIGS. 1-6.

Often, the wellbore 100 is drilled to a second depth within the formation 815. As described above in relation to FIG. 5, the drill string 880 of FIG. 13 is inserted into the casing string 102 and used to drill into the formation 815 to a second depth. During the drilling process, it is customary to introduce drilling fluid F1 into the drill string 880. The drilling fluid F1 flows down through the drill string 880, as indicated by the arrows labeled F1, then out through the passages 883 and 884. After exiting the passages 883 and 884, the drilling fluid F1 mingles with the particulate matter including cuttings produced from drilling into the earth formation 815, then carries the particulate matter including cuttings to the surface 865 by the fluid mixture F2, which includes the drilling fluid F1 and the particulate matter. The fluid mixture F2 flows to the surface 865 through an annulus between the outer diameter of the drill string 880 and the inner surface 806 of the casing string 102, as indicated by the arrows labeled F2. The drilling fluid F1 is ordinarily introduced in order to clear the wellbore 100 of the cuttings and to ease the path of the drill string 880 through the formation 815 during the drilling process.

While the fluid mixture F2 is circulating up through the annulus between the drill string 880 and the casing string 102, the flow meter 875 may be used to measure the flow rate of the fluid mixture F2 in real time. Furthermore, the flow meter 875 may be utilized to measure in real time the component fractions of oil, water, mud, gas, and/or particulate matter including cuttings, flowing up through the annulus in the fluid mixture F2. Specifically, the optical sensors 891, 892, 814, and 816 send the measured wellbore parameters up through the optical cable 855 to the SMCU 860. The optical signal processing portion of the SMCU 860 calculates the flow rate and component fractions of the fluid mixture F2, as described in the above-incorporated application (Ser. No. 10/348,040) utilizing the equations and algorithms disclosed in the above-incorporated application. This process is repeated for additional drill strings and casing strings.

By utilizing the flow meter 875 to obtain real-time measurements while drilling, the composition of the drilling fluid F1 may be altered to optimize drilling conditions, and the flow rate of the drilling fluid F1 may be adjusted to provide the desired composition and/or flow rate of the fluid mixture F2. Additionally, the real-time measurements while drilling may prove helpful in indicating the amount of cuttings making it to the surface 865 of the wellbore 100, specifically by measuring the amount of cuttings present in the fluid mixture F2 while it is flowing up through the annulus using the flow meter 875, then measuring the amount of cuttings present in the fluid exiting to the surface 865. The composition and/or flow rate of the drilling fluid F1 may then be adjusted during the drilling process to ensure, for example, that the cuttings do not accumulate within the wellbore 100 and hinder the path of the drill string 880 through the formation 815.

While the sensors 891, 892, 814, 816 are preferably disposed around the outer surface 807 of the casing string 102, it is within the scope of the invention for one or more of the sensors 891, 892, 814, 816 to be located around the inner surface of the casing string 102 or embedded within the casing string 102. In an application of the present invention, temperature, pressure, and flow rate measurements obtained by the above embodiments may be utilized to determine when an underbalanced condition is reached within the wellbore 100.

While the foregoing is directed to embodiments of the present invention, other and further embodiments of the invention may be devised without departing from the basic scope thereof, and the scope thereof is determined by the claims that follow.

The invention claimed is:

1. A method of using a downhole deployment valve (DDV) in a wellbore extending to a first depth, the method comprising:

assembling the DDV as part of a tubular string, the DDV comprising:

a valve member movable between an open and a closed position;

an axial bore therethrough in communication with an axial bore of the tubular string when the valve member is in the open position, the valve member substantially sealing a first portion of the tubular string bore from a second portion of the tubular string bore when the valve member is in the closed position; and a sensor configured to sense a parameter of the wellbore or a parameter of a formation;

running the tubular string into the wellbore;

running a drill string through the tubular string bore and the DDV bore, the drill string comprising a drill bit located at an axial end thereof;

drilling the wellbore to a second depth using the drill string and the drill bit;

sensing the wellbore or formation parameter with the sensor while drilling the wellbore to the second depth; and adjusting a trajectory of the drill string while drilling the wellbore to the second depth.

2. The method of claim 1, further comprising adjusting a composition or amount of drilling fluid while drilling the wellbore to the second depth.

3. The method of claim 1, wherein sensing the wellbore or formation parameter with the sensor comprises receiving at least one acoustic wave transmitted into a formation from a seismic source.

4. The method of claim 3, wherein the seismic source transmits the at least one acoustic wave from the drill string to the sensor.

5. The method of claim 3, wherein the seismic source transmits the at least one acoustic wave from a surface of the wellbore to the sensor.

6. The method of claim 3, wherein the seismic source transmits the at least one acoustic wave from an adjacent wellbore to the sensor.

7. The method of claim 3, wherein the seismic source transmits the at least one acoustic wave from the drill string vibrating against the wellbore to the sensor.

8. The method of claim 1, wherein the wellbore or formation parameter is a microseismic measurement.

9. A method of using a downhole deployment valve (DDV) in a wellbore extending to a first depth, the method comprising:

assembling the DDV as part of a tubular string, the DDV comprising:

a valve member movable between an open and a closed position;

an axial bore therethrough in communication with an axial bore of the tubular string when the valve member is in the open position, the valve member substantially sealing a first portion of the tubular string bore from a second portion of the tubular string bore when the valve member is in the closed position; and a sensor configured to sense a parameter of the DDV, a parameter of the wellbore, or a parameter of a formation;

assembling a flow meter as part of the tubular string;

running the tubular string into the wellbore;

running a drill string through the tubular string bore and the DDV bore, the drill string comprising a drill bit located at an axial end thereof;

drilling the wellbore to a second depth using the drill string and the drill bit;

injecting drilling fluid through the drill string while drilling the wellbore to the second depth, wherein the drilling fluid returns from the drill bit through the tubular string;

measuring characteristics of the return fluid using the flow meter; and determining at least one of a volumetric phase fraction for the return fluid and flow rate of the return fluid based on the measured fluid characteristics.

10. The method of claim 9, further comprising adjusting the injection rate of the drilling fluid.

11. The method of claim 9, further comprising using the at least one of the volumetric phase fraction and the flow rate to determine formation properties while drilling the wellbore to the second depth.

12. A method of using a downhole deployment valve (DDV) in a wellbore extending to a first depth, the method comprising:

assembling the DDV as part of a tubular string, the DDV comprising:

a valve member movable between an open and a closed position;

an axial bore therethrough in communication with an axial bore of the tubular string when the valve member is in the open position, the valve member substantially sealing a first portion of the tubular string bore from a second portion of the tubular string bore when the valve member is in the closed position; and a sensor configured to sense a parameter of the wellbore or a parameter of a formation;

running the tubular string into the wellbore;

running a drill string through the tubular string bore and the DDV bore, the drill string comprising a drill bit located at an axial end thereof;

drilling the wellbore to a second depth using the drill string and the drill bit; and receiving at least one acoustic wave with the sensor transmitted into a formation from a seismic source while drilling the wellbore to the second depth.

13. The method of claim 12, wherein the seismic source transmits the at least one acoustic wave from the drill string to the sensor.

14. The method of claim 12, wherein the seismic source transmits the at least one acoustic wave from a surface of the wellbore to the sensor.

15. The method of claim 12, wherein the seismic source transmits the at least one acoustic wave from an adjacent wellbore to the sensor.

16. The method of claim 12, wherein the seismic source transmits the at least one acoustic wave from the drill string vibrating against the wellbore to the sensor.

17. A method of using a downhole deployment valve (DDV) in a wellbore extending to a first depth, the method comprising:

assembling the DDV as part of a tubular string, the DDV comprising:

a valve member movable between an open and a closed position;

an axial bore therethrough in communication with an axial bore of the tubular string when the valve member is in the open position, the valve member substantially sealing a first portion of the tubular string bore from a second portion of the tubular string bore when the valve member is in the closed position; and a microseismic sensor;

running the tubular string into the wellbore;

running a drill string through the tubular string bore and the DDV bore, the drill string comprising a drill bit located at an axial end thereof;

drilling the wellbore to a second depth using the drill string and the drill bit; and making a microseismic measurement with the sensor while drilling the wellbore to the second depth.

18. A method of drilling a wellbore, comprising:

running a drill string into the wellbore, through a bore of a tubular string, and along or through an open valve member, the tubular string comprising:

the valve member moveable between the open position and a closed position, wherein:

the valve member substantially seals a first portion of the tubular string bore from a second portion of the tubular string bore in the closed position, and the valve member is a flapper or ball, a first pressure sensor, and a control line operable to provide communication between the sensor and a surface of the wellbore;

drilling the wellbore using the drill string; and measuring a pressure of the wellbore while drilling using the first pressure sensor.

19. A method of drilling a wellbore, comprising:

running a drill string into the wellbore, through a bore of a tubular string, and along or through an open valve member, the tubular string comprising:

the valve member moveable between the open position and a closed position, wherein:

the valve member substantially seals a first portion of the tubular string bore from a second portion of the tubular string bore in the closed position, and the valve member is a flapper or ball, a first pressure sensor in fluid communication with the first portion of the bore, a second pressure sensor in fluid communication with the second portion of the bore, and a control line operable to provide communication between the sensors and a surface of the wellbore; and drilling the wellbore using the drill string.

20. The method of claim 18, wherein the valve member is located at a depth in the wellbore of at least 90 feet from the surface.

21. The method of claim 18, wherein:

the tubular string extends from a wellhead located at the surface, the wellhead comprises a rotating drilling head (RDH) or a stripper and a valve assembly; and the method further comprises engaging the drill string with the RDH or stripper.

22. The method of claim 21, wherein the wellbore is drilled in an underbalanced or near underbalanced condition.

23. The method of claim 21, further comprising using the valve assembly to control flow of fluid from the wellbore while drilling the wellbore.

24. The method of claim 18, further comprising cementing the tubular string to the wellbore.

25. The method of claim 18, further comprising:

retracting the drill string to the first portion of the bore;

closing the valve member;

depressurizing the first portion of the bore; and removing the drill string from the wellbore.

26. A method of drilling a wellbore, comprising:

running a drill string into the wellbore, through a bore of a tubular string, and along or through an open valve member, the tubular string comprising:

the valve member moveable between the open position and a closed position, wherein:

the valve member substantially seals a first portion of the tubular string bore from a second portion of the tubular string bore in the closed position, and the valve member is a flapper or ball, a sensor operable to sense a parameter of the valve member or a parameter of the wellbore, and a control line operable to provide communication between the sensor and the surface, wherein:

the tubular string extends from a wellhead located at a surface of the wellbore, and the wellhead comprises a rotating drilling head (RDH) or a stripper and a valve assembly;

engaging the drill string with the RDH or stripper; and drilling the wellbore using the drill string.

* * * * *